US007016634B2

(12) United States Patent
Kitani et al.

(10) Patent No.: US 7,016,634 B2
(45) Date of Patent: Mar. 21, 2006

(54) IMAGE FORMING APPARATUS AND IMAGE FORMING METHOD

(75) Inventors: Tomoe Kitani, Hachioji (JP); Masao Asano, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 118 days.

(21) Appl. No.: 10/798,027

(22) Filed: Mar. 11, 2004

(65) Prior Publication Data

US 2004/0265016 A1 Dec. 30, 2004

(30) Foreign Application Priority Data

Jun. 24, 2003 (JP) ..... 2003-179460

(51) Int. Cl.
*G03G 15/01* (2006.01)

(52) U.S. Cl. ..... 399/298

(58) Field of Classification Search ..... 399/298, 399/299, 306

See application file for complete search history.

(56) References Cited

U.S. PATENT DOCUMENTS 5,837,414 A * 11/1998 Kitani et al. ..... 430/108.1
2004/0190951 A1 * 9/2004 Kitani et al. ..... 399/299
2004/0248023 A1 * 12/2004 Asano et al. ..... 430/45

FOREIGN PATENT DOCUMENTS

JP 08-272197 10/1996
JP 09319134 A * 12/1997
JP 2002-372820 12/2002

* cited by examiner

*Primary Examiner*—Quana Grainger
(74) *Attorney, Agent, or Firm*—Lucas & Mercanti, LLP

(57) ABSTRACT

An image forming apparatus includes: four image forming units for black, yellow, magenta and cyan respectively, each image forming unit having at least a developing member; and a photosensitive member on which a toner image is formed with either a black toner, a yellow toner, a magenta toner or a cyan toner of each of developing members, and in which the formed toner image is transferred onto a recording material; wherein turbidity of each of the black toner, the yellow toner, the magenta toner and the cyan toner used in each developing member of the four image forming units is less than 60, maximum difference between the turbidities of the black toner, the yellow toner, the magenta toner and the cyan toner is in a range of 5 to 45, the photosensitive member is an amorphous silicon-based photosensitive member, and the black toner has the turbidity of less than 25.

21 Claims, 6 Drawing Sheets

IMAGE FORMING APPARATUS AND IMAGE FORMING METHOD

BACKGROUND OF THE INVENTION

1. Field of the Invention

The present invention relates to an image forming apparatus to be used as a color copying machine and a color printer, and to an image forming method using the image forming apparatus.

2. Description of the Related Art

According to an earlier development, an image forming apparatus of so-called the tandem system, that forms color toner images for each colors separately on different photosensitive members (hereinafter also referred to simply as "the photosensitive member") and then interposes these color toner images onto an intermediate transfer member or a recording material to form images, has been known as one for forming color images. (See, for example, Japanese Patent Laid-open No. 2001-222129).

However, this tandem system is a system to form color images by forming electrostatic latent images on separate photosensitive bodies in accordance with color-separated image information, that is, image information corresponding to each colors of yellow, magenta, cyan and black, respectively, then forming color toner images corresponding to each colors of yellow, magenta, cyan and black, and subsequently interposing these toner images onto an intermediate transfer member or a recording material. This color image forming apparatus of the tandem system is adopted to form color images by interposing toner images with different color hues formed by a plurality of image forming units onto an intermediate transfer member or a recording material. Therefore, it is feasible to develop a high-speed image forming apparatus of the electrophotography system capable of forming color images at a high speed based on the image forming apparatus of the tandem system.

However, since photosensitive bodies are separately used for color toner images for each colors in the tandem system, there is a tendency that uneven development of colors and deviation in colors are easily caused unless the performance of the respective photosensitive bodies is stabilized.

On the other hand, a technology to form fine latent images on a photosensitive member by using a light source for exposure having a small spot diameter to thereby form images with fine dots has been developed for aiming at improving color images so that they are furnished with high image qualities. As an example, a method to use a light source of which spot diameter is 4,000 $\mu m^2$ or less to form highly-fined latent images on a photosensitive member is known (See, e.g., Japanese Patent Laid-open No. H8-272197). When such an exposure system with a small spot diameter is used for the image forming by means of the tandem system, it is required that the performance of the photosensitive bodies respectively corresponding to the above-mentioned four colors must have been stabilized.

Besides, when an organic photosensitive member is used in the image forming apparatus of the tandem system, the attrition of a photosensitive member for black, that forms images of characters too, is greater than the photosensitive bodies for yellow, magenta and cyan. In case of an image forming unit in which the respective photosensitive bodies for Y (yellow), M (magenta), C (cyan) and Bk (black) integrally included, the life of the image forming unit is determined in accordance with the life of the photosensitive member for black. This leads to a problem that the photosensitive bodies for the other colors are obliged to be replaced before they reach to their lives for use. In order to solve such a problem, an image forming apparatus of the tandem system, in which only the photosensitive member for black is formed of an amorphous silicon-based photosensitive member and the photosensitive bodies for the other colors are formed of organic photosensitive bodies, has been proposed (Seem, e.g., Japanese Patent Laid-open No. 2002-372820). When an amorphous silicon-based photosensitive member is used only for black, the difference in the attrition of the film thicknesses of the photosensitive bodies between the amorphous silicon-based and the organic photosensitive bodies will be reduced. However, there is a remarkable difference in the adherence of a toner to a photosensitive member depending upon if it is an amorphous silicon-based photosensitive member or an organic photosensitive member. Therefore, when the both types of photosensitive bodies are used at the same time, great differences may be caused in the development performance, transfer performance and other performances of between the toners, which lead to a problem that it will be difficult to obtain a stable image quality for both of images of characters and color images.

For example, due to the dispersion in the qualities of the manufactured toners, the variation in the sizes particularly of black dot images becomes greater than color dot images. Accordingly, there is a problem of causing insufficient definition in color images.

Furthermore, since there is a difference in the toner filming performance onto the surface of a photosensitive member between an amorphous silicon-based photosensitive member and an organic photosensitive member, there is another problem that both qualities of images of characters and color images deteriorate during the use of toners of the similar properties for a long time.

Although an example of the tandem system that is furnished with different photosensitive bodies dedicated for each of the four colors was given above, the relevant problems may be caused even the case of using a single amorphous silicon-based photosensitive member common to the four colors. Specifically, in case of using a single amorphous silicon-based photosensitive member, the characteristics of each toner for a different color varies from one another on the same amorphous silicon-based photosensitive member, whereby a problem of causing dispersion of colors and so on has come up. Still further, in case of using a single amorphous silicon-based photosensitive member, the deterioration of the photosensitive member becomes greater because the photosensitive member is commonly used for all colors, and there is a tendency that the dispersion of colors becomes further greater.

The problems as described above are raised when using the amorphous silicon-based photosensitive member, or jointly using the amorphous silicon-based photosensitive member and the organic photosensitive member in an image forming apparatus of the tandem system, or solely using a single amorphous silicon-based photosensitive member. However, in actuality, countermeasures for solving the above-described problems have not been well-studied yet.

SUMMARY OF THE INVENTION

It is an object of the present invention to solve the above-described problems. The object of the present invention is directed to improve image quality when image forming is carried out with the use of an amorphous silicon-based photosensitive member and toners of four colors, and to provide electrophotographic images with colors of good quality using an image forming apparatus of the tandem system employing an intermediate transfer member. In particular, the present invention is directed to provide an image forming apparatus and an image forming method of the electrophotographic system, which improve the reproducibility of black dot images formed by a color image forming apparatus of the tandem system employing an intermediate transfer member, provides compatibly with images of characters and color images with good quality, and at the same time, prevents defects of images, such as transfer errors often caused during the transferring process employing an intermediate transfer member and black spots from occurring, and reproduces color images with good definition and fresh color hues.

It is found out that, in order to prevent image quality from the deterioration, which is caused due to the difference in the attrition of the film thickness derived from the frequency of use between the photosensitive member be used for an image forming unit for black and the photosensitive member to be used for an image forming unit for color images, in the image forming apparatus for forming color images according to the present invention, wherein four image forming units and an intermediate transfer member are included, it is necessary to use an amorphous silicon-based photosensitive member, the attrition of the film thickness of which is less, for the photosensitive member for black and an organic photosensitive member for the photosensitive member for the other colors, and at the same time, to improve the development and transfer performances and so on, those which are different between the amorphous silicon-based photosensitive member and the organic photosensitive member, whereby achieving the present invention. That is, it was found out that, for achieving the above-described object, it is necessary to optimize the development and transfer performances and so on, those which are different from one another between the amorphous silicon-based photosensitive member and the organic photosensitive member, on each of those photosensitive bodies, and at the same time, to establish a given relation between the respective toners in the four image forming units in order to simultaneously satisfy the primary transfer performance of the toner images formed on the respective photosensitive bodies onto the intermediate transfer member and the secondary transfer performance thereof onto the recording material, whereby achieving the present invention.

In order to solve the problem, in accordance with the first aspect of the invention, an image forming apparatus comprises:

four image forming units for black, yellow, magenta and cyan respectively, each image forming unit having at least a developing member; and a photosensitive member on which a toner image is formed with either a black toner, a yellow toner, a magenta toner or a cyan toner of each of developing members, and in which the formed toner image is transferred onto a recording material;

wherein turbidity of each of the black toner, the yellow toner, the magenta toner and the cyan toner used in each developing member of the four image forming units is less than 60, maximum difference between the turbidities of the black toner, the yellow toner, the magenta toner and the cyan toner is in a range of 5 to 45, the photosensitive member is an amorphous silicon-based photosensitive member, and the black toner has the turbidity of less than 25.

The apparatus may further comprise: an intermediate transfer member for transferring each toner image on the recording material after each toner image formed on the respective photosensitive member is transferred to the intermediate transfer member.

Preferably, the maximum difference between the turbidities of the black toner, the yellow toner, the magenta toner and the cyan toner is in a range of 10 to 35.

Preferably, the turbidity of the black toner is less than 20.

In accordance with the second aspect of the invention, an image forming apparatus comprises:

four image forming units for black, yellow, magenta and cyan respectively, each image forming unit having at least a photosensitive member, an exposing member, a developing member and a transferring member;

wherein the four image forming units form each toner image with either a black toner, a yellow toner, a magenta toner or a cyan toner, on the photosensitive member so that each toner image is transferred on a recording material; and turbidity of each of the black toner, the yellow toner, the magenta toner and the cyan toner is less than 60, maximum difference between the turbidities of the black toner, the yellow toner, the magenta toner and the cyan toner is in a range of 5 to 45, the photosensitive member on which the black toner image is formed is an amorphous silicon-based photosensitive member, and the black toner has the turbidity of less than 25.

Preferably, each of the image forming units has a charging member and a cleaning member.

The apparatus may further comprise: an intermediate transfer member for transferring each toner image on the recording material after each toner image formed on the respective photosensitive members is transferred to the intermediate transfer member.

Preferably, the maximum difference between the turbidities of the black toner, the yellow toner, the magenta toner and the cyan toner is in a range of 10 to 35.

Preferably, the turbidity of the black toner is less than 20.

In accordance with the third aspect of the invention, an image forming apparatus comprises:

four image forming units for black, yellow, magenta and cyan respectively, each image forming unit having at least a photosensitive member, an exposing member, a developing member and a transferring member; and an intermediate transfer member for collectively transferring a color toner image on a recording material after the color toner image is transferred to the intermediate transfer member by overlapping each single color toner image in order, which is formed with either a black toner, a yellow toner, a magenta toner or a cyan toner on each photosensitive member;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, the photosensitive member of the image forming unit for black is an amorphous silicon-based photosensitive member, and the black toner has the turbidity of less than 25.

Preferably, each of the image forming units has a charging member and a cleaning member.

Preferably, each photosensitive member of the image forming units for yellow, magenta and cyan is an organic photosensitive member.

Preferably, the each photosensitive member of the image forming units for yellow, magenta and cyan is an organic photosensitive member of which a surface layer contains fluorine-containing resin particles.

Preferably, the maximum difference between the turbidities of the black toner, the yellow toner, the magenta toner and the cyan toner is in a range of 10 to 35.

Preferably, the turbidity of the black toner is less than 20.

In accordance with the fourth aspect of the invention, an image forming method comprises:

forming an electrostatic latent image on an amorphous silicon-based photosensitive member, and developing the electrostatic latent image with either a black toner, a yellow toner, a magenta toner or a cyan toner to obtain each of toner image;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, and the turbidity of the black toner is less than 25.

Preferably, the method further comprises transferring the toner image to an intermediate transfer member.

Preferably, toner images formed with a plurality of color toners are transferred to the intermediate transfer member.

Preferably, the difference between the turbidities of the black toner, the yellow toner, the magenta toner and the cyan toner is in a range of 10 to 35.

Preferably, the turbidity of the black toner is less than 20.

In accordance with the fifth aspect of the invention, an image forming apparatus for:

developing an electrostatic latent image formed on an amorphous silicon-based photosensitive member with either a black toner, a yellow toner, a magenta toner or a cyan toner to obtain each of toner image; and transferring the toner image to an intermediate transfer member;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, and the turbidity of the black toner is less than 25.

The present invention constituted as described above enables to form both monochromic and color images in good dot images and moreover prepare good electrophotographic images being prevented from the presence of transfer errors and defects of images such as black spots formation.

BRIEF DESCRIPTION OF THE DRAWINGS

The present invention will become more fully understood from the detailed description given hereinbelow and the appended drawings. However, these are not intended as a definition of the limits of the present invention, and wherein.

DETAILED DESCRIPTION OF THE PREFERRED EMBODIMENTS

Figure 1:
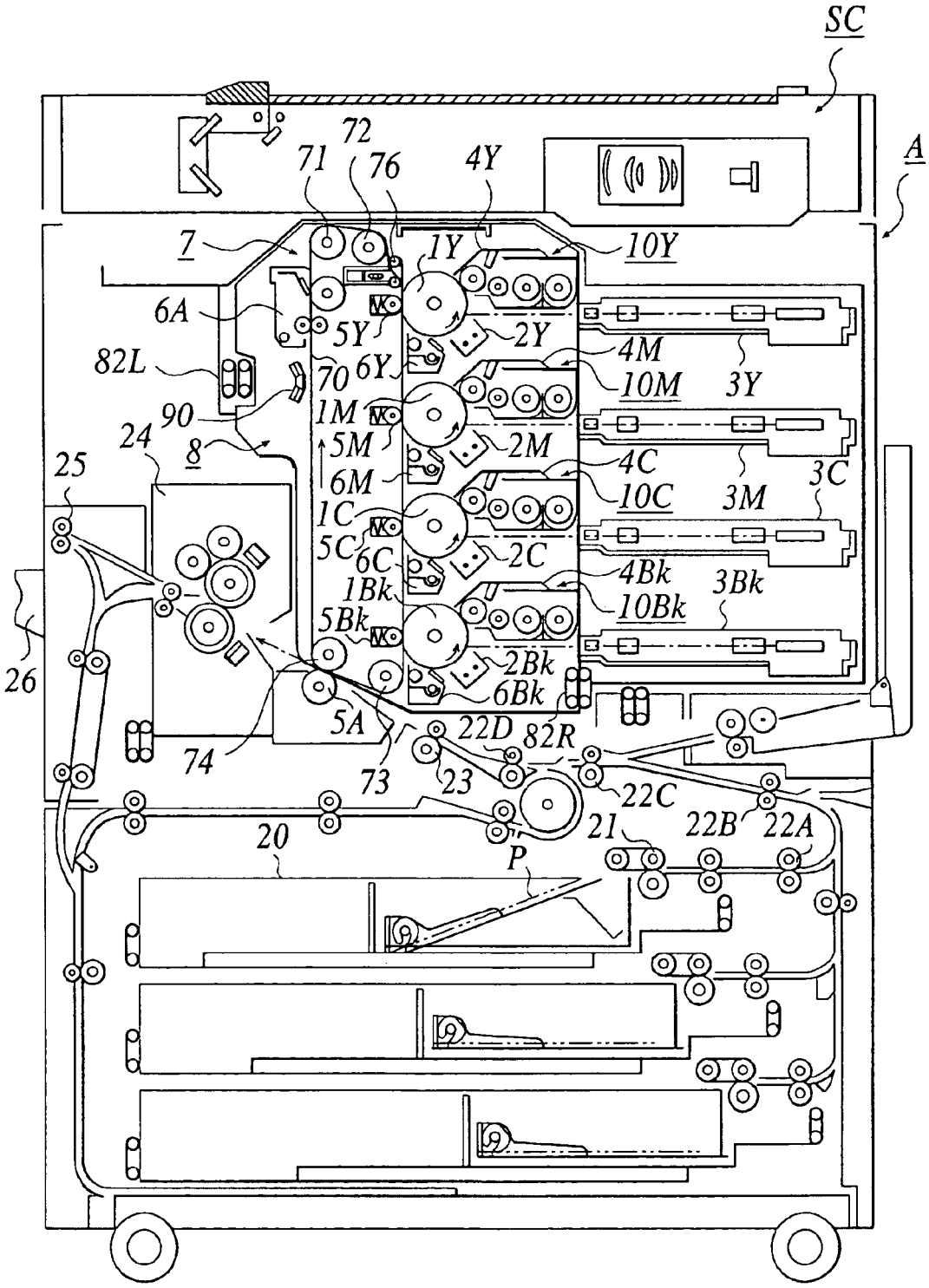
FIG. 1 is a sectional configurative view of the color image forming apparatus of a first embodiment according to the present invention.

The embodiments for the present invention will now be described in the following. Note that it is not intended to define the technical scope and the meanings of the terms of the appended claims with the descriptions in this section. Furthermore, the affirmative description in the embodiments in the following is intended to show the best mode, but it is not intended to limit the meanings of the terms used in the present invention and the technical scope thereof.

Now, the present invention will be explained further in detail.

In the present invention, the turbidity of a toner is defined as follows and it can be measured.

Turbidity is defined here as; HAZE value=Diffusing components/Total permeable components Measuring method of Toner Turbidity; A toner in an amount of 5.0 g is dispersed in 50 ml aqueous solution containing 1 ml of a surface-active agent (Cleaning Power Family, Manufactured by Kao Co., Ltd.) and is then separated by means of a centrifuge (2000 rpm, 10 minutes). Since the toner component is precipitated, only the supernatant that contains free components is sampled. Using the supernatant, the rate of the diffusing components relative to the total components permeable to an incident light is calculated by means of COH-300A manufactured by Nihon Denshoku Co., Ltd., and the obtained HAZE value is used as the turbidity of the toner.

When the turbidity value of the toner is high, it means that the amount of the free particulate components such as external additives is much.

The image forming apparatus according to the present invention is characterized in that the turbidity of each of the toners used for the developing member including four image forming units is less than 60 and the maximum difference in the turbidities between the respective color toners is in a range of 5 to 45, and a black toner of which turbidity is less than 25 is contained in the developing member for the image forming unit for black. By constituting the apparatus as described above, it may be feasible to improve the dot reproducibility of both images of characters and color images, to remarkably improve the performance to transfer the color toner images superimposed onto the intermediate transfer member to a recording material, to improve the defects of images, such as transfer errors and black spots formation, and to form color images with good definition and fresh color hues.

Specifically, if the turbidity of each of the color toners is more than 60, the free components in the particulates of the toner scatters on the photosensitive member and the intermediate transfer member because the free component of the particulates become to be so much, which leads to a tendency of diminishing the definition of images. Furthermore, the free components tend to attach onto the surface of the organic photosensitive member in the turbidity range of more than 60 to easily cause defects of images such as black spots (spotted images like strawberry shape) and deteriorate the dot reproducibility of colors. Besides, even though the turbidity of each color toner is less than 60, the transfer performance thereof from the intermediate transfer member to the recording material tends to deteriorate and the defects of images, such as transfer errors and image density reduction of color images, and lowering of the image definition and the like tend to be caused, if the maximum difference in the turbidity between the respective color toners is less than 5. On the other hand, if the maximum difference in the turbidity between the respective color toners is more than 45, it becomes difficult to control the balance of the electrification amount between the respective toners, whereby lowering of the dot reproducibility of colors and the deterioration in the image definition are easily caused.

Although it is described above that the turbidity of the respective color toners is less than 60, it is preferably less than 50, and most preferably less than 40. Besides, the maximum difference in the turbidity between the respective color toners is in a range of 5 to 45, however, it is preferably in a range of 10 to 35.

The color toners used in the present invention preferably include a group of four color toners consisting of a black toner, a yellow toner, a magenta toner and a cyan toner. Precisely speaking, these four color toners are toners developing colors belong to black, yellow, magenta and cyan, respectively. It is sufficient for the four color toners if they are the ones capable of forming color images according to the subtractive color process. With the use of the four color toners, it is made feasible to form both images of characters and color images with good definition and fresh color hues.

Among the color toners, the turbidity of the black toner is less than 25. By maintaining the turbidity of the black toner at less than 25, dotted latent images on the amorphous silicon-based photosensitive member can be precisely developed into toner images, and both character images and color images can be formed with good definition and less deterioration of reproduced colors all the time.

Among the color toners, the toner having the maximum turbidity is preferably a color toner other than a black toner. It is particularly preferable that the toner having the maximum turbidity is a yellow toner. The yellow toner is relatively hard to lower the definition of images and reproduction of colors, even though the turbidity thereof is raised to a higher value.

In order to control the turbidity of the respective color toners within a range of less than 60 and to fix the maximum difference in the turbidities between the respective color toners to a range of 5 to 45 in accordance with the above-described definition and the measuring method, it is important to control the selection of the type of the external additive particles that attaches onto the surface of the toner and the fixing degree of the external additive particles (hereinafter also referred to simply as "external additive") onto the surface of the toner.

The number-average particle size of the external additive preferably used in the present invention is in a range of 0.05 to 0.5 $\mu$m.

When the particle size of the external additive is less than 0.05 $\mu$m, the transfer performance of the toner declines because the physical adhesion between the toner photosensitive bodies is not tempered, accordingly, reduction in the density of the images will be caused.

When the particle size is longer than 0.5 $\mu$m, the external additive having been once attached easily detaches and is liberated due to the stress given by stirring or the like in a developing container. Therefore, the amount of the liberated external additive is accumulated and then re-coagulated in the developing container. The coagulated product becomes the seeds at the time of transferring and causes the transfer errors. Further, since the liberated components in a much amount adhere onto the surface of the photosensitive member, filming to the surface of the photosensitive member tends to be easily caused.

The adding amount of the external additive to the toner is preferably in a range of 0.05 to 5.0 parts by mass (hereinafter "parts" refers to "parts by mass" unless otherwise specified), and particularly preferable 1.0 to 4.0 parts relative to 100 parts of the colored particles (the toner before the addition of the external additive).

If the adding amount is less than 0.5 parts, the transfer performance tends to be diminished since the effect of reducing the physical adhesion cannot be gained. Besides, if the adding amount is more than 5.0 parts, the external additive tends to be separated and liberated easily due to the stress given by, for example, stirring in the developing container because of the presence of the excess amount of the external additive on the surface of the toner. Accordingly, the liberated additive is accumulated in the developing container and re-coagulated in the developing container to form the seeds. In case the seeds are contaminated into the developed toner images, they often cause transfer errors at the time of transferring. Furthermore, since the liberated components in a much amount adhere to the surface of the photosensitive member, toner filming onto the surface of the photosensitive member tends to be easily caused.

There is no limitation in the method to control the adhesion degree to the colored particles of the external additive, and any commonly-used apparatuses for externally adding particles and fixing or sticking particles onto the surface of the toner may be used.

Concrete examples of the usable apparatus for the fixing include Henschel mixer, Lehdige mixer, TURBO SPHERE mixer and the like. In particular, Henschel mixer is suitably used because the mixing and fixing processes of the external additive may be carried out with the same apparatus and in view of easiness of stirring and mixing, and easiness of heating from the exterior.

During the above-described fixing process, it is desirable to carry out the mixing at a speed of 5 to 50 m/s, and more desirably 10 to 40 m/s, at the circumference of the tip end of a stirring wing. Further, it is preferable to carry out the preliminary mixing to render the external additive to uniformly adhere onto the surface of resin particles. Besides, for the temperature control, it is preferable to adjust the temperature to a required temperature by means of feeding warm water or the like from the exterior.

Measurement of the temperature is carried out at the portion where the toner is flowing while it has been stirred and mixed. Further, it is preferable to pass cold water through the mixing apparatus following to the fixing process to carry out cooling and pulverizing processes.

Control of the degree of fixation of the external additive onto the surface of the colored particles of the external additive may be carried out by stirring and mixing the colored particles with the external additive under a temperature condition of Tg-20≦(Temperature for Stirring and Mixing)≦Tg+20, and uniformly adhering the particles of the external additive onto the surface of the colored particles for an arbitrarily-adjusted period of time while applying mechanical impact force.

The above-indicated Tg denotes a glass transition temperature of the toner or the integral resin constituting the toner. The glass transition temperatures were measured by means of DSC7 differential scanning calorimeter (manufactured by Perkin Elmer Inc.). In this measurements, the temperature was elevated from 0° C. to 200° C. at a rate of 10° C./min and then cooled from 200° C. to 0° C. at a rate of 10° C./min to eliminate the previous history. Then, the temperature was elevated again from 0° C. to 200° C. at a rate of 10° C./min to determine the endothermic peak temperature at the second heating, which gives the value of Tg. In case there are plural endothermic peak temperatures, the main endothermic peak temperature was used for Tg.

The Tg to be used for the toner or the integral resin constituting the toner is preferably a temperature in a range of 40 to 70° C. If the Tg is lower than 40° C., the shelf stability of the toner becomes inferior, and as a result, the toner coagulates. If the Tg is higher than 70° C., it is not preferable in view of the fixing property and the productivity.

Another external additive may be further added following to the adhesion control of the external additive previously used in view of giving the fluidity. However, it is required that the turbidity in the form of toner falls within the range defined above in the present invention.

With regard to the measurements for the number-average particle size of the external additive, the particles were observed by means of a transmission electron microscope, and the number-average particle size was indicated by using the particles measured by image analysis.

There is no limitation for the composition of the external additive, and any external additive may be arbitrarily used.

For example, as the inorganic external additive, various types of inorganic oxides, nitrides and borides and the like may be suitably used. Specific examples of the inorganic external additive include, for example, silica, alumina, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride and the like.

In addition thereto, the products obtainable by making the inorganic external additives hydrophobic may be used. When the hydrophobization is carried out, it is preferable to make the external additives hydrophobic using a coupler, such as various titanium couplers and silane couplers. The inorganic external additives having been made hydrophobic with a higher fatty acid metal salt, such as aluminum stearate, zinc stearate and calcium stearate, may be preferably used also.

Similarly, when an external additive comprising a resin is used, there is no particular limitation in the composition. In general, particulate organic external additives based on vinyl compounds, and particulate external additives, such as condensates of melamine and formaldehyde, polyesters, polycarbonates, polyamides, and polyurethanes, may be preferably used. Because, these polymers and the like may be manufactured easily according to a manufacturing method selected from emulsion polymerization, suspension polymerization and the like.

The preferred toner used for the present invention will now be described in the following.

The particle size of the toner used in the present invention is preferably in a range of 3 to 8 μm in terms of the number-average particle size. This particle size may be controlled by adjusting the concentration of a flocculant, the adding amount of an organic solvent, a period of time for fusion and the composition of the polymer itself in the manufacturing process as will be described later, when the toner particles are formed in accordance with the polymerization method.

When the number-average particle size is in a range of 3 to 8 μm, the toner particulates having greater adhesion and adhering to a photosensitive member to cause the filming become less in the number. In addition thereto, the transfer efficiency is improved, and the quality of the images in half tone, and of fine lines and dots are also improved.

The toner used in the present invention is preferably a toner consisting of particles, in terms of the particle size distribution, for which the sum (M) of the relative frequency ($m_1$) of the toner particles belonging to the most frequent class and the relative frequency ($m_2$) of the toner particles belonging to a class next to the most frequent class is 70% or higher in the frequency histogram representing the particle size distribution based on the number of the particles, wherein a natural logarithm 1 nD is given on the transverse when the particle size of the toner is D (μm), and the transverse is divided into a plurality of classes at an interval of 0.23.

When the sum (M) of the relative frequency ($m_1$) and the relative frequency ($m_2$) is 70% or higher, the dispersion in the particle size distribution of the toner particles becomes narrow. Hence, it becomes feasible to improve the primary and secondary transfer performance of the toner images and to inhibit the occurrence of the selection phenomenon securely by using such a toner in the image forming process.

In the present invention, the histogram that represents the particle size distribution based on the number of particles is a histogram representing a particle size distribution based on the number of particles wherein a natural logarithm 1 nD (D: Particle size of the individual toner particle) is divided into a plurality of classes at an interval of 0.23, (0 to 0.23: 0.23 to 0.46: 0.46 to 0.69: 0.69 to 0.92: 0.92 to 1.15: 1.15 to 1.38: 1.38 to 1.61: 1.61 to 1.84: 1.84 to 2.07: 2.07 to 2.30: 2.30 to 2.53: 2.53 to 2.76: and so on). This histogram is prepared by transferring the particle size data of a sample measured by means of a Coulter Multisizer to a computer via an I/O unit and processing the data on the computer according to the particle size distribution analysis program in accordance with the conditions as described in the following.

[Conditions for Measurements]

(1) Aperture: 100 μm (2) Preparation Method of Sample:

An appropriate amount of a surface-active agent (a neutral detergent) is added into an electrolyte [ASOTON R-11 (Manufactured by Coulter Scientific Japan)] in a volume of 50 to 100 ml and then stirred, followed by an addition of 10 to 20 mg of a sample to be measured. This mixture is subjected to a dispersing process for one minute by means of a supersonic disperser to prepare the sample for the measurements.

The particle size of the toner used in the present invention is preferably in a range of 3 to 8 μm in terms of the volume-average particle size. The volume-average particle size and particle size distribution of the toner may be measured by means of Coulter Counter TA-II, Coulter Multisizer, SLAD1100 (a laser diffraction type particle size measuring apparatus, manufactured by Shimazu Seisakusho) or the like. When Coulter Counter TA-II and Coulter Multisizer are used, the particle size measurements were conducted with respect to the particles having the particle sizes in a range of 2.0 to 40 μm with the used of an aperture with the aperture diameter of 100 μm.

There is no particular limitation for the method for manufacturing the toner. However, the toner manufactured according to the polymerization method (also referred to as "polymerized toner") is preferable because, for example, the method is simple as the manufacturing method and the polymerized toner is superior in the uniformity than pulverized toners.

The polymerized toner means a toner, the production of a binder resin for which and the formation of the shape thereof are made by polymerizing the raw material monomer for the binder resin and subsequently applying a chemical treatment. More specifically, the polymerized toner means a toner obtainable after it passed through a polymerization reaction, such as suspension polymerization and emulsion polymerization, and, if required, the subsequent fusion process of the particles with one another. Since the polymerized toner is produced by applying a polymerization reaction following to the uniform dispersion of the raw material monomer in water-base solvent system, it is possible to obtain a toner of which particle size and shape are uniform.

In any case, the object of the present invention may be achieved with any type of toner, as far as it can comply with the requirements of the present invention, irrespective of the pulverized toner or the polymerized toner.

<<Composition and Manufacturing Method of Toners Used in the Present Invention>>

The toner used in the present invention may be manufactured by employing the commonly-used pulverizing method, which mixes and kneads a binder resin, a coloring agent and other various additives to be added upon necessity in together, pulverizes and then classify them to prepare a toner, or by synthesizing resin particles containing a mold-releasing agent and a coloring agent in a medium.

The method for fusing resin particles in a water-base medium includes the methods disclosed in, for example, Japanese Patent Laid-opens Nos. 63-186253, 63-283749 and H7-146583, a method to form resin particles by means of salting-out/fusion-adherence process and so on.

The resin particles used in the present invention is preferably in a range of 50 to 2000 nm in terms of the weight-average particle size. These resin particles may be prepared according to any particle-forming polymerization method selected from emulsion polymerization, suspension polymerization, seed polymerization and so on, however, the emulsion polymerization is preferably used for this purpose.

In the present invention will be described in the following, any of the conventionally-known polymerizable monomers manufactured by any of the manufacturing methods may be used as the monomer to be used for manufacturing the resin. In addition, in order to comply with the required characteristics, one or more monomers may be used in combination.

There is no particular limitation for the binder resin used in the present invention, and any of commonly-known binder resins, such as styrene resins, acrylic resins, styrene-acrylic resins, polyester resins, styrene-butadiene resins and epoxy resins, may be used.

Concrete examples of the monomer forming styrene resins, acrylic resins and styrene-acrylic resins include styrene and styrene derivatives, such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene and p-n-dodecylstyrene; metacrylate derivatives, such as methyl metacrylate, ethyl metacrylate, n-butyl metacrylate, isopropyl metacrylate, isobutyl metacrylate, t-butyl metacrylate, n-octyl metacrylate, 2-ethylhexyl metacrylate, stearyl metacrylate, lauryl metacrylate, phenyl metacrylate, diethylaminoethyl metacrylate and dimethylaminoethyl metacrylate; acrylate derivatives, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate and diethylaminoethyl acrylate; and the like, and these monomers enumerated above may be used solely or in combination.

Concrete examples of the other vinyl polymers include olefins, such as ethylene, propylene and isobutylene; halogenated vinyl compounds, such as vinyl chloride, vinylidene chloride, vinyl bromide, vinyl fluoride and vinylidene fluoride; vinyl esters, such as vinyl propionate, vinyl acetate and vinyl benzoate; vinyl ethers, such as vinyl methyl ether and vinyl ethyl ether; vinyl ketones, such as vinyl methyl ketone, vinyl ethyl ketone and vinyl hexyl ketone; N-vinyl compounds, such as N-vinyl carbazole, N-vinyl indole and N-vinyl pyrrolidone; vinyl compounds, such as vinylnaphthalene and vinylpyridine; acrylates or metacrylates, such as acrylonitrile, metacrylonitrile, acrylamide, N-butyl acrylamide, N,N-dibutyl acrylamide, metacrylamide, N-butyl metacrylamide and N-octadecyl acrylamide. These vinyl monomers enumerated above may be used solely or in combination.

Further, examples of the monomer used for obtaining polymers containing carboxylic acid of styrene-acrylic resins (vinyl resins) include acrylic acid, metacrylic acid, α-ethylacrylic acid, fumaric acid, maleic acid, itaconic acid, cinnamic acid, maleic monobutyl ester, maleic monooctyl ester, cinnamic anhydride, alkenylsuccinic methyl half ester and the like.

Further, a crosslinker, such as divinylbenzene, ethylene glycol diacrylate, diethylene glycol diacrylate, triethylene glycol diacrylate, ethylene glycol dimetacrylate, diethylene glycol dimetacrylate and triethylene glycol dimetacrylate, may be added.

Besides, the polyester resin to be used is a resin that is obtained by condensation-polymerizing an at least bivalent carboxylic acid and an at least bivalent alcohol component. Examples of the bivalent carboxylic acid include maleic acid, fumaric acid, citraconic acid, itaconic acid, glutaconic acid, phthalic acid, isophthalic acid, telephthalic acid, succinic acid, adipic acid, sebacic acid, azelaic acid, malonic acid, n-dodecylsuccinic acid, n-dodecenylsuccinic acid, isododecylsuccinic acid, isododecenylsuccinic acid, n-octylsuccinic acid, n-octenylsuccinic acid and the like. The acid anhydrides of the compounds enumerated above may also be used.

In addition, examples of the bivalent alcohol component forming the polyester resins include etherificated bisphenols, such as polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl) propane; ethylene glycol, diethylene glycol, triethylene glycol, 1,2-propylene glycol, 1,3-propylene glycol, 1,4-butanediol, 1,4-butenediol, neo-pentyl glycol, 1,5-pentane glycol, 1,6-hexane glycol, 1,4-cyclohexane dimethanol, dipropylene glycol, polyethylene glycol, polypropylene glycol, polytetramethylene glycol, bisphenol A, bisphenol Z, hydrogen addition bisphenol A and the like.

Further, examples of the polyester resin having a crosslinked structure include trivalent carboxylic acids, for example, 1,2,4-benzenetricarboxylic acid, 2,5,7-naphthalenetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxyl acid, pyromellitic acid, enpole trimer acid, and the like. In addition, the crosslinked polyester resins may be prepared by adding any of the acid anhydrides of the above-enumerated acids and the polyvalent alcohol components thereof, specifically, sorbitol, 1,2,3,6-hexanetetrole, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene and the like.

In the present invention, inorganic and organic pigments may be used as the colorant to be used in the black toner (hereinafter also referred to as "toner Bk"), the yellow toner (hereinafter also referred to as "toner Y"), the magenta toner (hereinafter referred to as "toner M"), and the cyan toner (hereinafter also referred to as "toner C").

As the inorganic pigments, any of the conventionally-known ones may be used. Concrete examples of the inorganic pigments usable in the present invention are enumerated below.

The usable black pigments (black-type) include, for example, carbon black, such as furnace black, channel black, acetylene black, thermal black and lamp black, and magnetic powder, such as magnetite and ferrite may also be used.

These inorganic pigments may be used solely or a plurality of pigments may be selected to use in combination depending upon a request. The adding amount of the pigment is in a range of 2 to 20% by mass, and preferably 3 to 15% by mass relative to the mass of the polymer.

When the toner is used as a magnetic toner, the magnetite enumerated above may be added. In this case, the magnetite is preferably added into the toner at a rate of 20 to 60% by mass in view of providing a given magnetic property to the toner.

With regard to the organic pigments, any of the conventionally-known organic pigments may be used. Concrete examples of the usable organic pigments are enumerated in the following.

Examples of the pigment for magenta or red color (magenta type) include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222, and the like.

Examples of the pigment for orange or yellow (yellow type) include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138 and the like.

Examples of the pigments for green or cyan (cyan type) include C.I. pigment blue 15, C.I. pigment blue 15:2, C.I. pigment blue 15:3, C.I. pigment blue 16, C.I. pigment blue 60, C.I. pigment green 7 and the like.

These organic pigments enumerated above may be used solely, or a plurality of the pigments may be selected to use in combination depending upon a request. The adding amount of the organic pigment is in a range of 2 to 20% by mass, and preferably 3 to 15% by mass relatively to the mass of the polymer.

The colorant may be used after applying modification onto the surface. The conventionally-known surface modifying agent may be used for modifying the surface of the colorant in the present invention. Concretely, as the surface modifying agent, a silane coupler, a titanium coupler, an aluminum coupler and the like may be preferably used.

The toner obtained in the present invention may be added with a so-called external additive for the purpose of improving the fluidity thereof and easing handling at cleaning thereof. There is no particular limitation for the external additives as described above, and various types of inorganic particles, organic particles and lubricants may be used as the external additive.

Beside the external additive particles, the lubricant may be added into the toner as the external additive. Examples of the lubricant include metal salts of higher fatty acids, such as zinc, aluminum, copper, magnesium, calcium and other salts of stearic acid; zinc, manganese, iron, copper, magnesium and other salts of oleic acid; zinc, copper, magnesium, calcium and other salts of palmitic acid; zinc, calcium and other salts of linolic acid; and zinc, calcium and other salts of ricinolic acid.

The adding amount of the lubricant is preferably in a range of 0.1 to 5% by mass more or less relative to the mass of the toner.

In the step for preparing the toner, the above-described external additive may be added into the toner particles obtained above for the purpose of, for example, improving the fluidity and electrification property of the toner and easing handling at cleaning the toner. At the addition of the external additives, various known mixers, such as turbular mixer, Henschel mixer, Nauter mixer, and V-type mixer, may be used for the addition.

Other than the binder resin and the colorant, materials capable of providing the toner with various functions may be added as additives for toners. Specifically, a mold-releasing agent, charge control agent and the like may be added to the toner.

Besides, various known mold-releasing agents including olefinic waxes, such as polypropylene and polyethylene, and the denatured products thereof, natural waxed such as carnauba wax, and amide waxes such as fatty acid bisamide may be used for the toner of the present invention. As described above, it is preferable that these mold-releasing agents are added in the form of particles, and the particles are salted out together with the resin and the colorant and fused onto the toner.

Like the above, the charge control agent of various conventionally-known types capable of being dispersed in water may be used for the toner of the present invention. Specifically, nigrosine dyes, metal salts of naphthenic acid or higher fatty acids, alkoxylated amines, quaternary ammonium salt compounds, azo metal complexes, metal salts of salicylic acid or the metal complex thereof may be used as the charge control agent.

<<Developer>>

The toner used in the present invention may be used as either a developer comprising one component or a developer comprising two components. However, the toner is preferably used as a developer of two components.

When the toner is used as a developer comprising one component, other than the case where the toner is used directly as a non-magnetic one-component developer, it is normal to incorporate magnetic particles having a particle size of 0.1 to 5 $\mu$m into the particles of toner to use the toner as a magnetic one-component developer. The method to incorporate the magnetic particles is normally similar to that for the colorant, that is, the magnetic particles are incorporated into the non-spherical particles of the toner.

In addition thereto, the toner may be mixed with a carrier so that it is used as the developer comprising two components. In this case, the conventionally-known materials, such as metals including iron, ferrite. magnetite and so on, and alloys including alloys of the foresaid metals and aluminum, lead and the like, may be used as the magnetic particles used as the carrier. Among the metals exampled above, ferrite particles are preferably used. The magnetic particles having the volume-average particle size in a range of 15 to 100 $\mu$m, and more preferably 25 to 60 $\mu$m, are preferably used.

The volume-average particle size of the carrier may be measured by means of the laser diffraction type particle size measuring apparatus provided with a wet disperser, "HELOS" (Manufactured by SYMPATEC Inc.), as the representative example.

The carrier in which the magnetic particles are coated with a resin, or a so-called dispersion-in-resin type carrier in which the magnetic particles are dispersed in the resin is preferably used. There is no particular limitation for the resin composition for the coating use. For example, olefinic resins, styrene-based resins, styrene-acrylic resins, silicon-based resins, ester-based resins, fluorine-containing polymer type resins and the like may be used as the resin for the coating use. Also, there is no particular limitation for the resin forming the dispersion-in-resin type carrier, and any known carrier including, for example, styrene-acrylic resins, polyester resins, fluorine-containing resins and phenol resins may be used for this use.

The photosensitive member used in the present invention will now be described in detail below.

In the image forming apparatus according to the present invention, photosensitive members of two types, that is, an amorphous silicon-based photosensitive member for image forming unit for black and an organic photosensitive member for image forming unit for colors, are used.

Now, the amorphous silicon-based photosensitive member and the organic photosensitive member will be described in the following.

The amorphous silicon-based photosensitive member used in this invention is defined as a photosensitive member including an amorphous silicon layer or a noncrystalline silicon layer.

For the amorphous silicon-based photosensitive bodies described above, the known amorphous silicon-based photosensitive bodies disclosed in Japanese Patent Laid-opens Nos. 54-83746, 57-11556, 60-67951, 62-168161, 57-158650 and the like may be used.

Now, a brief explanation will be given below on the amorphous silicon-based photosensitive member (hereinafter also referred to as "a-Si photosensitive member") according to the present invention.

Figure 5A:
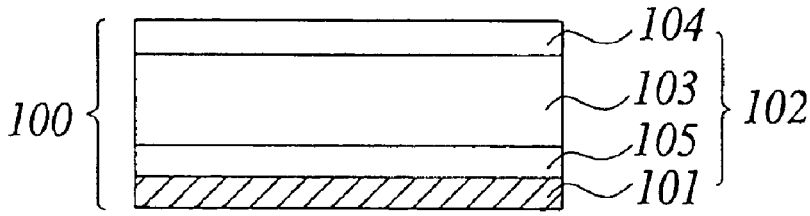
FIGS. 5A and 5B are schematic configurative views for explaining the representative layer structure of the a-Si photosensitive member according to the present invention.
Figure 5B:
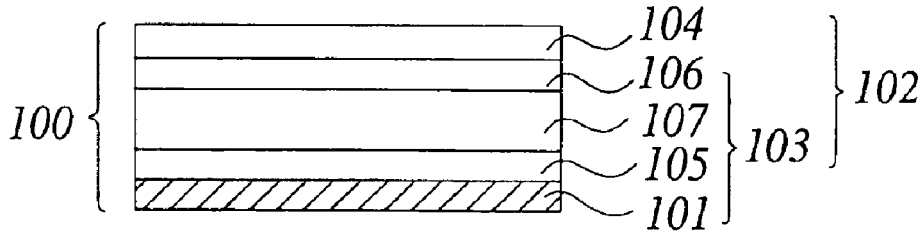

FIGS. 5A and 5B are schematic configurative views for explaining the representative layer configuration of the a-Si photosensitive member of the present invention.

FIG. 5A is a schematic configurative view for explaining the layer configuration of the a-Si photosensitive member according to the present invention. In the a-Si photosensitive member 100 shown in FIG. 5A, photosensitive layers 102 are provided on an electrically conductive support 101 for supporting the photosensitive member. The photosensitive layers 102 comprises a photoconductive layer 103 consisting of a-Si:H, X and having photoconductive property, an amorphous silicon-based surface layer 104 and an amorphous silicon-based charge injection inhibiting layer 105.

FIG. 5B is a schematic configurative view for explaining the layer configuration of the a-Si photosensitive member according to the present invention. In the photosensitive member 100 used for the image forming apparatus shown in FIG. 5B, photosensitive layers 102 are provided on an electrically conductive support 101 for supporting the photosensitive member. The photosensitive layers 102 comprises a charge generating layer 106 consisting of a-Si:H, X and a charge transporting layer 107, both constituting the photoconductive layer 103, an amorphous silicon-based surface layer 104 and an amorphous silicon-based charge injection inhibiting layer 105.

Note that the layer configurations of the a-Si photosensitive member are only representative examples, and the surface layer and the charge injection inhibiting layer are not always essential components in the layer configuration.

The a-Si photosensitive member is generally formed by heating the electrically conductive support up to a temperature ranging from 50 to 400° C. and forming the photoconductive layer comprising a-Si according to a film forming method selected from the high-vacuum metal deposition process, the spattering process, the ion plating process, the thermal CVD process, the photochemical vapor deposition process, and the plasma CVD process (hereinafter referred to as "PCVD process"). Among the processes mentioned above, the PCVD process, wherein the raw material gas is decomposed by an application of direct current, high-frequency waves or microwaves glow discharge and an a-Si deposited layer is formed on the support, is preferably employed.

Next, the layer configuration of the a-Si photosensitive member will be described below.

[Electrically Conductive Support]

The electrically conductive support used for the a-Si photosensitive member according to the present invention may be either electrically conductive or electrically insulated. Examples of the material of the electrically conductive support include known metals, such as Al and Fe, the alloys thereof, for example, stainless steel and the like. In addition thereto, a film or sheet made of a synthetic resin, or an electrically insulated support made from glass, a ceramic material or the like, at least the surface of which side where the photosensitive layer is formed is processed so as to be electrically conductive, may also be used. The shape of the electrically conductive support may be cylindrical or plate-shaped with either smooth surfaces or concavo-convex surfaces, or may be in the form of an endless belt.

In particular, when image recordings are carried out using coherence light such as laser beams, the surface of the electrically conductive support may be provided with asperities for the purpose of further efficiently preventing the images from the defects appearing on visible images that are caused by so-called interference fringe patterns. The asperities provided on the surface of the support 101 may be formed according to known methods disclosed in Japanese Patent Laid-opens Nos. 60-168156, 60-178457, 60-225854, etc.

As the alternative method for effectively preventing the images from the defects caused by the interference fringe patterns when coherence light such as laser beams are used, the asperities consisting of a plurality of spherical tracing grooves may be provided on the surface of the electrically conductive support 101. That is, the surface of the electrically conductive support 101 has the asperities that are finer than the resolution required for the photosensitive member 100 for the image forming apparatus and the asperities are formed with a plurality of spherical tracing grooves. The asperities formed with the plurality of spherical tracing grooves to be provided on the surface of the electrically conductive support 101 are formed according to the known method disclosed in Japanese Patent Laid-open No. 61-231561.

Furthermore, as still another alternative method for further efficiently prevent the images from the defects caused by the interference fringe patterns when coherence light such as laser beams was used, an interference preventing layer or region such as a light absorbing layer may be provided inside the photosensitive layer 102 or thereunderneath.

[Photoconductive Layer]

The a-Si photosensitive member according to the present invention is preferably formed on the electrically conductive support, and if required, on an undercoating layer (not shown) in order to achieve the object thereof. The photoconductive layer 103 is formed according to the vacuum deposited-film forming method, where the numerical conditions for the forming film parameter are properly fixed so that the desired characteristic features may be obtained. Specifically, the photoconductive layer may be formed according to various thin-film deposition methods, for example, the glow discharge method (such as alternative current discharge CVD process including low-frequency CVD process, high-frequency CVD process, and microwave CVD process, or direct current discharge CVD process, etc.), the spattering method, the high-vacuum metal deposition, the ion plating method, the photochemical vapor deposition, the thermal CVD and so on. Any of these thin-film deposition methods is fitly selected and employed depending upon the factors, such as the manufacturing conditions, the degree of load under a capital investment for facilities, the manufacturing scale, and the desired characteristics for the photosensitive member for the image forming apparatus use to be manufactured. From the viewpoint that control of the conditions at manufacturing the photosensitive member for image forming apparatus having the desired characteristic features is relatively easy, the glow discharge method is preferably employed.

Basically, the formation of the photoconductive layer 103 according to the glow discharge method may be achieved by introducing the raw material gas for silicon (Si) supply that can supply Si atoms, and the raw material gas for hydrogen (H) supply that can supply H atoms and/or the raw material gas for halogen atoms (X) supply that can supply X both in a desired gaseous state into a reactor of which interior can be made in a reduced-pressure state, generating the glow discharge in the reactor, and forming a layer comprising a-Si:H, X on a given support 101 having been installed at a predetermined position in advance.

In the present invention, it is preferable that hydrogen atoms and/or halogen atoms are contained in the photoconductive layer 103. This is because that these atoms are essential for compensating unbonded hands of the hydrogen atoms or the halogen atoms to improve the quality of the layer, in particular, the photoconductivity and the charge retention property. Therefore, it is desirable that the content of the hydrogen atoms or the halogen atoms, or the content of the sum of the hydrogen atoms and halogen atoms is fixed in a range of 10 to 30% by atom number, more preferably 15 to 25% by atom number, relative to the sum of the silicon atoms and the hydrogen atoms and/or the halogen atoms.

As the substance that can be a gas used for supplying Si to be used for forming the a-Si photosensitive member according to the present invention, silicon hydride (a silane compound) in gas or being gasifiable may be effectively used. Further, in view of easy handling at the time of forming the layer, good efficiency for supplying Si and the like, $SiH_4$ and $Si_2H_6$ may be preferably used.

And, in order to introduce hydrogen atoms structurally into the photoconductive layer 103 to be formed and make the control of the introduction ratio of the hydrogen atoms more easy to thereby obtain the film property that can achieve the object of the present invention, it is preferable to further incorporate $H_2$ and/or He, or a gas of a silicon compound containing hydrogen atoms in a desired amount into the foresaid gas to form the layer. Note that the gas may be incorporated solely, or plural types of gases mixed at a given ratio may be incorporated in combination.

Besides, as the raw material gas for halogen atom supply used in the present invention, for example, halogen gases, halides, halogenous compounds containing halogens, and halogenous compounds in gas or gasifiable halogenous compounds, such as silane derivatives substituted with halogens may be effectively used. Furthermore, hydrogenated halogen-containing silicon compounds in gas or being gasifiable containing silicon atoms and halogen atoms as the components may be given as the effective raw material gases.

The control of the amounts of hydrogen atoms and halogen atoms to be contained in the photoconductive layer 103 may be achieved, for example, by controlling the temperature of the support 101, the introducing amounts of the raw material to be used for including hydrogen atoms and/or halogen atoms in the photoconductive layer into the reactor, and power for discharge, etc.

In the a-Si photosensitive member according to the present invention, it is preferable to include atoms that control the conductivity upon necessity in the photoconductive layer 103. The atoms that control the conductivity may be contained in the photoconductive layer 103 in the sate that they are uniformly distributed all over the layer, or it is allowable even if there are some parts in the thickness direction of the layer where the atoms are contained in the state that they have been distributed unevenly.

As the atoms that control the conductivity, so-called impurities in the semiconductor field are given. As widely-known, such atoms (the 3b group atoms) that give the p-type conductive property and belong to the 3b group of the periodic law table, or such atoms (the 5b group atoms) that give the n-type conductive property and belong to the 5b group of the periodic law table may be used as the atoms for controlling the conductivity.

Further, the raw material substances that introduce the atoms for controlling the conductivity as described above may be diluted upon necessity with $H_2$ and/or He for the use.

Besides, in the a-Si photosensitive member according to the present invention, it is also effective to include carbon atoms and/or oxygen atoms and/or nitrogen atoms in the photoconductive layer 103. The carbon atoms and/or oxygen atoms and/or nitrogen atoms may be contained in the photoconductive layer uniformly all over the layer, or it is allowable even if those atoms are unevenly distributed in some parts such that the contents thereof vary in the thickness direction of the photoconductive layer.

In the a-Si photosensitive member according to the present invention, the thickness of the photoconductive layer 103 is determined properly upon a request from viewpoints of the electron microscope photographic property and economical effects, and the thickness is preferably in a range of 20 to 50 $\mu$m, more preferably 23 to 45 $\mu$m, and optimally 25 to 40 $\mu$m.

In order to achieve the object of the present invention and form the photoconductive layer 103 provided with the desired film property, the mixing ratio of the gas for Si supply and the diluent gas, the gas pressure in the reactor, the power for discharge and the temperature of the electrically conductive support may be properly fixed.

Note that the conditions described above normally cannot be fixed independently, and it is desirable to fix the optimal values based on the mutual and organic relation between the conditions for forming the photosensitive member provided with the desired properties.

[Surface Layer]

In the a-Si photosensitive member according to the present invention, a surface layer 104 is preferably further formed on the photoconductive layer 103 having been formed on the electrically conductive support 101 as described above. The surface layer 104 has a free surface and is provided for the purpose of achieving the object of the present invention mainly in terms of the humidity resistance, the continuously repeated use characteristic, the electrical pressure resistance, the use environment characteristic, and the durability.

For the surface layer 104, a material based on amorphous silicon (a-Si), amorphous silicon containing hydrogen atoms (H) and/or halogen atoms (X) and further containing carbon atoms (hereinafter referred to as "a-SiC:H,X"), amorphous silicon containing hydrogen atoms (H) and/or halogen atoms (X) and further containing oxygen atoms (hereinafter referred to as "a-SiO:H,X"), amorphous silicon containing hydrogen atoms (H) and/or halogen atoms (X) and further containing nitrogen atoms (hereinafter referred to as "a-SiN:H,X"), amorphous silicon containing hydrogen atoms (H) and/or halogen atoms (X) and further containing at least one of carbon atoms, oxygen atoms and nitrogen atoms (hereinafter referred to as "a-SiCON:H,X") and the like may be suitably used.

For the a-Si photosensitive member according to the present invention, the surface layer 104 is preferably formed according to the vacuum deposited-film forming method with properly fixing the numerical conditions for the forming film parameters so that the desired characteristics can be obtained for the surface layer. Specifically, the surface layer may be formed according to various thin-film deposition methods, for example, the glow discharge method (such as alternative current discharge CVD process including low-frequency CVD process, high-frequency CVD process, and microwave CVD process, or direct current discharge CVD process, etc.), the spattering method, the high-vacuum metal deposition, the ion plating method, the photochemical vapor deposition, the thermal CVD and so on. These thin-film deposition method is properly selected and employed depending upon the factors, such as the manufacturing conditions, the degree of load under the capital investment for facilities, the manufacturing scale, the characteristics desired for the photosensitive member for the image forming apparatus to be manufactured and the like. In view of the productivity of the photosensitive member, it is preferable to employ the deposition method like the method for the photoconductive layer.

For example, the surface layer 104 comprising a-SiC:H,X may be formed according to the glow discharge method, in principle, in which a raw material gas for silicon atom (Si) supply that can supply Si, a raw material gas for carbon atoms (C) supply that can supply C, a raw material gas for hydrogen atom (H) supply that can supply H and/or a raw material gas for halogen atom (X) supply that can supply X are introduced in a desired gaseous state into a reactor which can render the inside thereof in reduced pressure condition, the glow discharge is generated inside the reactor, and a layer comprising a-SiC:H,X is formed on the support 101 on which the photoconductive layer 103 was formed at the predetermined position in advance.

The amount of carbon when the surface layer is comprised with a-SiC as the main component is preferably in a range of 30 to 90% relative to the sum of the silicon atoms and the carbon atoms.

Besides, it is necessary in the a-Si photosensitive member according to the present invention that hydrogen atoms and/or halogen atoms are contained in the surface layer 104. This is because that these atoms are essential for compensating the unbonded hands of the silicon atoms, improving the quality of the layer and, in particular, improving the photoconductive characteristic and the charge retention characteristic. It is desirable to fix the content of hydrogen atoms normally in a range of 30 to 70% by atom number, suitably 35 to 65% by atom number, and optimally 40 to 60% by atom number relative to the total amount of the all component atoms. Also, it is desirable to fix the content of fluorine atoms normally in a range of 0.01 to 15% by atom number, suitably 0.1 to 10% by atom number, and optimally 0.6 to 4% by atom number.

It is known that the defects in the surface layer (i.e., dangling bonds mainly of silicon atoms and carbon atoms) give adverse effects to the properties as the photosensitive member used for the image forming apparatus, the adverse effects including, for example, deterioration in the electrification property due to the injection of charges from the free surface into the photoconductive layer, fluctuation in the electrification property caused by the change in the surface structure under the use environment, e.g., high humidity, and generation of the residual image phenomenon at the time of carrying out the repeated uses, that is caused due to the trapping of charges on the impaired portions in the surface layer.

It is feasible to control the hydrogen content in the surface layer at a level of 30% by atom number or higher to reduce the defects in the surface layer to a great extent and to thereby improve the electrical properties and the continuous use at high-speed performance. On the other hand, if the hydrogen content in the surface layer exceeds 70% by atom number, the hardness of the surface layer is reduced and the durability thereof is also reduced accordingly.

Further, it is feasible to control the fluorine content in the surface layer at a range of 0.01% by atom number or more to effectively achieve the establishment of the bondings between the silicon atoms and the carbon atoms in the surface layer. In addition, the fluorine atoms in the surface layer function to prevent the bondings between the silicon atoms and the carbon atoms from being cut due to the damage caused by corona or the like. On the other hand, if the fluorine content in the surface layer exceeds 15% by atom number, the effect of generating the bondings between the silicon atoms and the carbon atoms in the surface layer and the effect of preventing the cutting of the bondings between the silicon atoms and the carbon atoms cannot be obtained. Furthermore, since the excess fluorine atoms inhibit the moving performance of the carrier inside the surface layer, the residual potential and image memories became remarkably recognizable.

The contents of fluorine atoms and hydrogen atoms in the surface layer may be controlled by adjusting the flow rate of $H_2$ gas, the temperature of the electrically conductive support, the power for discharge, the gas pressure, etc.

In the a-Si photosensitive member according to the present invention, it is desirable that the thickness of the surface layer 104 is fixed to normally in a range of 0.01 to 3 $\mu$m, suitably 0.05 to 2 $\mu$m, and optimally 0.1 to 1 $\mu$m. If the thickness is thinner than 0.01 $\mu$m, the surface layer may be disappeared due to the abrasion or the like during the use of the photosensitive member, while if the thickness exceeds 3 μm, deterioration in the electrophotographic performance such as the increase of the residual potential may occur.

The surface layer 104 of the a-Si photosensitive member according to the present invention is carefully formed in order to be provided with the required properties as it is desired. Specifically, the substance comprising Si, C, and/or N, and/or O, H, and/or X as the components takes a conformation for its own ranging from crystal to amorphous depending upon the formation conditions, and shows an electrical physical natures ranging from electrically conductive to semiconducting and insulating, and ranging from photoconductive to non-photoconductive, respectively. Therefore, in the present invention, an accurate selection of the formation conditions complying with what are desired must be made so that the compounds provided with the desired characteristics in accordance with the object may be formed.

For example, in case that the surface layer 104 is formed for aiming at improving the pressure resistance as the main object, it is used as a non-single crystal material of which electrical insulating behavior is outstanding in the use environment.

Besides, in case that the surface layer is formed for aiming at improving the continuous repeated use performance and the use environment characteristics, the degree of the electrical insulating property is moderated to a certain extent, and it is formed as a non-single crystal material having certain sensitivity to an irradiated light.

Furthermore, in order to prevent the flow of images due to the low resistance of the surface layer 104 or the effects such as the residual potential, and for improving the electrification efficiency on the other hand, it is preferable to properly control the resistance value of the surface layer at the time of forming the surface layer.

Still further, for the a-Si photosensitive member according to the present invention, it is effective to form a blocking layer (an underside surface layer), in which the contents of carbon atoms, oxygen atoms and nitrogen atoms are reduced so as to be less than those contents in the surface layer, between the photoconductive layer and the surface layer for further improving the characteristics such as the electrification performance of the photosensitive member.

Also, between the surface layer 104 and the photoconductive layer 103, a region in which the contents of carbon atoms and/or oxygen atoms and/or nitrogen atoms change so as to de-escalate toward the photoconductive layer 103 may be formed. With such a region, the coherence between the surface layer and the photoconductive layer is improved, and the effect due to the interference caused by light reflection at the interface may be reduced.

[Charge Injection Inhibiting Layer]

It is more effective for the performance of the a-Si photosensitive member according to the present invention to form a charge injection inhibiting layer, that functions to inhibit the charge injection from the electrically conductive support side, between the electronically conductive support and the photoconductive layer. That is, the charge injection inhibiting layer has a so-called polarity dependence with which the charge injection inhibiting layer has a function to prevent the charges from being injected from the electrically conductive support side to the photoconductive layer side when the photosensitive layer is applied with a given polar electrification onto the free surface, but it does not exert its function when the photosensitive layer is applied with the reverse electrification. Therefore, in order to provide such a function, it is preferable to include atoms having conductivity into the charge injection inhibiting layer at a content relatively greater than that in the photoconductive layer.

The atoms controlling the conductivity may be contained in the layer such that they are distributed uniformly in all over the layer, or it is allowable even if they are distributed uniformly in the thickness direction of the layer but there are some portions in the layer where the atoms are contained such that they are distributed unevenly. In case the distribution density is uneven, it is suitable that the atoms are contained in the layer such that the greater amount thereof is distributed in the support side.

However, in any case, it is preferable that the atoms are contained such that they are uniformly distributed all over the surface of the support and in the inner direction across the parallel surfaces in order to attain the uniformity of the characteristics in the inner direction across the surfaces.

As the atoms controlling the conductivity contained in the charge injection inhibiting layer, the so-called impurities in the field of semiconductor, and the atoms belonging to the group 3 of the periodic law table giving the p-type conducting property and the atoms belonging to the Group 5 of the periodic law table giving the n-type conducting property may be used.

In the a-Si photosensitive member according to the present invention, the content of the conductivity-controlling atoms contained in the charge injection inhibiting layer is properly fixed as it is desired so as to effectively achieve the object of the present invention.

Furthermore, it is possible to further improve the coherence between the charge injection inhibiting layer and the other layer that is formed in direct contact with the charge injection inhibiting layer by causing the charge injection inhibiting layer to contain at least one of carbon atoms, nitrogen atoms and oxygen atoms.

The carbon atoms, the nitrogen atoms or the oxygen atoms contained in the charge injection inhibiting layer may be uniformly distributed in the layer, or it may be allowed even if those atoms are contained all over the layer only in the thickness direction across the layer and there are some portions where they are contained such that they are distributed unevenly. However, in any case, it is preferable that the atoms are contained in such a manner that they are uniformly distributed all over the surface of the electrically conductive support and in the inner direction across the parallel surfaces in order to attain the uniformity of the characteristics in the inner direction across the surfaces.

In the a-Si photosensitive member according to the present invention, the contents of the carbon atoms and/or nitrogen atoms and/or oxygen atoms contained in the whole layer region of the charge injection inhibiting layer are properly fixed so that the object of the present invention can be achieved effectively.

Hydrogen atoms and/or halogen atoms contained in the charge injection inhibiting layer compensate the unbonded hands of atoms existing in the layer and exert their effects to improve the property of the film.

In the a-Si photosensitive member according to the present invention, the thickness of the charge injection inhibiting layer is preferably fixed in a range of 0.1 to 5 μm, more preferably 0.3 to 4 μm, and optimally 0.5 to 3 μm, in view of obtaining desirable electrophotographic characteristics, economically advantageous effects and so on.

For forming the charge injection inhibiting layer in the a-Si photosensitive member according to the present invention, the vacuum deposition method similar to the above-described method for forming the photoconductive layer is employed.

Besides, in the a-Si photosensitive member according to the present invention, it is desirable that a region of the layer, wherein at least aluminum atoms, silicon atoms, hydrogen atoms or/and halogen atoms are contained in the thickness direction across the layer such that they are distributed unevenly, is included in the part of the photosensitive layer 102 which is located at the electrically conductive support 101 side.

Furthermore, in the a-Si photosensitive member according to the present invention, a cohesion layer including $Si_3N_4$, $SiO_2$, SiO or silicon atoms as the base substrate and comprising a noncrystalline material containing hydrogen atoms and/or halogen atoms, carbon atoms and/or oxygen atoms and/or nitrogen atoms may be formed for the purpose of further improving the coherence between the electrically conductive support 101 and the photoconductive layer 103 or the charge injection inhibiting layer 105.

Still further, as described above, a light absorption layer for preventing the interference patterns caused by the reflected light from the support from being generated may be formed in the a-Si photosensitive member. These charge injection inhibiting layer, the photoconductive layer, the surface layer, etc. are laminated in turn to prepare the a-Si photosensitive member that can be positively or negatively electrified.

In the present invention, the organic photosensitive member is meant as a photosensitive member comprising an organic compound provided with at least one of the charge generating function and the charge transporting function, both of those which functions are essential for constituting the photosensitive member. The organic photosensitive member according to the present invention includes all of known organic photosensitive members, such as photosensitive bodies comprising known organic charge generating substances or organic charge transporting substances, and photosensitive bodies comprising polymer complexes capable of exerting the charge generating function and the charge transporting function.

Now, the configuration of the organic photosensitive member will be briefly described below.

[Electrically Conductive Support]

A sheet-shaped or cylinder-shaped electrically conductive support is used as the electrically conductive support used for the photosensitive member according to the present invention.

The cylinder-shaped electrically conductive support specified in this invention is meant as a cylinder-shaped support required for rotating by itself to form images in the endless manner, and the electrically conductive support having the straightness of 0.1 mm or less and the libration of 0.1 mm or less is preferably used. If the straightness and the libration exceed the above-defined range, it becomes difficult to form images with good quality.

As the electrically conductive support, a metal drum comprising aluminum or nickel, or a plastic drum on which aluminum, tin oxide indium oxide or the like is deposited, or a paper/plastic drum coated with an electrically conductive substance may be used. It is preferable that the specific resistance of the electrically conductive support is $10^3$ Ωcm or less at normal temperatures.

An electrically conductive support, on the surface of which an anodized aluminum film with sealed pores is formed, may be used as the electrically conductive support used in this invention. The application of the anodized aluminum is carried out normally in an acidic bath using, for example, chromic acid, sulfuric acid, oxalic acid, phosphoric acid, boric acid, sulfamic acid, or the like, and the best results may be obtained by an anodizing process in sulfuric acid. In case of the anodizing process in sulfuric acid, it is preferable to fix the concentration of sulfuric acid at 100 to 200 g/l, the aluminum ion concentration at 1 to 10 g/l, the temperature of the solution at around 20° C., and an applied voltage at about 20V. However, there is no limitation for the conditions as fixed above. And, the average thickness of the anodizing-processed film is preferably 20 μm or less under normal conditions, and particularly preferable 10 μm or less.

[Intermediate Layer]

In this invention, it is preferable to form an intermediate layer provided with barrier function between the electrically conductive support and the photosensitive layer. The intermediate layer in which titanium oxide particulates are contained in a distributed state in a binder resin such as polyamide is particularly preferable. The average particle size of the titanium oxide particulates is favorably in a range of 10 to 400 nm in terms of the number-average primary particle size, and preferably in a range of 15 to 20 nm. If the average particle size is less than 10 nm, the preventing effect of the moire generation in virtue of the intermediate layer is diminished. On the other hand, if the average size is greater than 400 nm, the precipitation of the titanium oxide particulates in the intermediate layer coating solution tends to be occurred easily. As a result, the uniform dispersing property of the titanium oxide particulates in the intermediate layer becomes inferior, and the occurrence of black plopping tends to be increased. The intermediate layer coating solution in which the titanium oxide particulates having the number-average particle size in the above-defined range are used has good dispersion stability, and the intermediate layer prepared with such a solution has good environmental characteristics and anti-cracking characteristic as well as good function of preventing the black plopping generation.

The titanium oxide particulates used in this invention has various shapes, such as arborescent, aciform, granular and the like. Any of the titanium oxide particulates having the shapes as described above may be used irrespective of their crystalline forms, such as anatase-form, rutile-form, and amorphous-form, and the particulates containing two or more of those crystalline forms may be used in combination. Among the titanium oxide particulates in various shapes and crystalline forms, the one of granular shape and rutile-form is the best to use.

The titanium oxide particulates are preferably surface-treated. In particular, the titanium oxide particulates of which surface is treated plural times, and the final treatment was carried out with the use of a reactive organic silicon compound are preferable to use. Furthermore, it is preferable to carry out the surface treatments plural times and to use at least one selected from alumina, silica and zirconia in at least one time of the surface treatments and a reactive organic compound in the final surface treatment.

Note that the alumina treatment, the silica treatment, and the zirconia treatment means a treatment to separate out alumina, silica and zirconia on the surface of the titanium oxide particulates, respectively, and hydrates of alumina, silica and zirconia are included in the above-described alumina, silica and zirconia separated out on the surface. And, the surface treatment with the reactive organic silicon compound means that the reactive organic silicon compound is used for the treatment solution.

As described above, as a result of carrying out the surface treatments of the titanium oxide particulates more than two times, the surfaces of the titanium oxide particulates may be uniformly coated (treated). When the titanium oxide particulates of which surfaces are treated as described above are used for the intermediate layer, the dispersing property of the titanium oxide particulates in the intermediate layer is improved. As a result, it is made possible to obtain the photosensitive member with excellent quality which does not cause the defects of images such as black plopping and so on.

Note that examples of the preferred reactive organic silicon compound used in the surface treatment include various alkoxysilanes, such as methyltrimethoxysilane, n-butyltrimethoxysilane, n-hexyltrimethoxysilane and dimethyldimethoxysilane, and methylhydrogen polysiloxane.

[Photosensitive Layer]

The photosensitive layer in the photosensitive member according to the present invention may have a single layer structure having the charge generating function and the charge transporting function in the single layer, that is formed on the intermediate layer. However, it is more preferable for the photosensitive layer to have a structure including the charge generating layer (CGL) and the charge transporting layer (CTL) to those which the two functions of the photosensitive layer separately shifted. As a result of forming a structure to separate the functions, it is made possible to control the increase of the residual potential generated in association with the repeated used at a low level and to facilitate the control of the other electrophotographic characteristics in accordance with purposes. In case of the photosensitive member for negative electrification use, it is preferable to configure the charge generating layer (CGL) on the intermediate layer and the charge transporting layer (CTL) on the charge generating layer. In case of the photosensitive member for positive electrification use, the order of the layer configuration is reverse to that of the photosensitive member for negative electrification use. The most preferred photosensitive layer configuration in this invention is the configuration of the photosensitive member for negative electrification use having the function-separated structure.

Now, the configuration of the photosensitive layer of the function-separated photosensitive member for negative electrification use will be explained in the following.

[Charge Generating Layer]

In the charge generating layer, a charge generating material (CGM) is contained. As the other constitutional component materials thereof, a binder resin and the other additives may be contained.

For the charge generating material (CGM) used in this invention, a commonly-known charge generating material may be used. The examples thereof include, for example, phthalocyanine pigments, azo pigments, perylene pigments, azulenium pigments and the like. Among the above-enumerated pigments, the CGM that can minimize the increase of the residual potential caused in association with the repeated uses is one that has a stereostructure and potential structure capable of forming a stable coagulated structure between a plurality of molecules. Concrete examples of such a CGM include phthalocyanine pigments and perylene pigments, each having a specific crystalline structure. For example, CGMs, such as titanylphthalocyanine, of which Bragg angle 2θ against the Cu-Kα line has the maximum peak at 27.2 degree, and benzimidazoleperylene, of which Bragg angle 2θ against the same has the maximum peak at 12.4 degree, cause almost no deterioration in association with the repeated uses thereof and can reduce the increase of the residual potential.

When a binder is used for the charge generating layer as a dispersing carrier for CGM, publicly-known resins may be used as the binder. The most preferred examples of such a resin include formal resins, butyral resins, silicon resins, silicon denatured-butyral resins, phenoxy resins and so on. The ratio of the charge generating material to the binder resin is preferably 20 to 600 parts by mass relative to 100 parts by mass of the binder resin. The increase of the residual potential associated with the repeated uses may be decreased by using any of these resins. Note that the thickness of the charge generating layer is preferably in a range of 0.01 to 2 μm.

[Charge Transporting Layer]

In the charge transporting layer, a charge transporting material (CTM) and a binder resin for dispersing CTM to form a film are contained. Upon requirements, other additives such as an antioxidant may be contained.

As the charge transporting material (CTM), for example, triphenylamine derivatives, hydrazone compounds, styryl compounds, benzidine compounds, butadiene compounds, etc. may be used. At forming the layer, these charge transporting materials are normally dissolved in the binder resin, respectively. The combined use of CTMs capable of minimizing the increase of the residual potential appendant to the repeated uses is a combination of CTMs that has such a characteristic that the ionization potential difference therebetween is 0.5 (eV) or less, and preferably 0.25 (eV) or less.

The ionization potentials of CGM and CTM are measured by means of a surface analyzer, AC-1 (Manufactured by Riken Keiki Co., Ltd.).

Examples of the resin used for the charge transporting layer (CTL) include, for example, polystyrene, acrylic resins, metacrylic resins, vinyl chloride resins, vinyl acetate resins, poly(vinyl butyral) resins, epoxy resins, polyurethane resins, phenol resins, polyester resins, alkyd resins, polycarbonate resins, silicon resins, melamine resins, and copolymers comprising 2 or more of the repeating units of the above-enumerated resins. Beside these insulated resins, macromolecule organic semiconductors such as poly-N-vinylcarbazole may also be used.

The most preferred binder resin to be used for CTL is a polycarbonate resin. A polycarbonate resin is the most preferred resin as the binder since it makes the dispersibility and electrophotographic properties of CTM better. The combining ratio of the charge transporting material to the binder resin is preferably in a range of 10 to 200 parts by mass relative to 100 parts by mass of the binder resin. And, the thickness of the charge transporting layer is preferably in a range of 10 to 50 μm. Alternatively, the charge transporting layer according to this invention may be formed in a multilayered structure, and the most upper layer thereof may be provided with the function of a surface protection layer.

Besides, it is preferable to include an antioxidant in the charge transporting layer. The representative antioxidant is a material having a nature to prevent or inhibit the action of oxygen under a certain condition, such as light, heat and discharge, against self-oxidizing materials existing inside the organic photosensitive member or on the surface thereof.

[Surface Protection Layer]

Beside the above-described charge transporting layer, a surface protection layer may be formed in the photosensitive member in order to strengthen the abrasion resistance, to improve the electrification property or to provide with the charge injecting property.

In the organic photosensitive member used for the image forming apparatus according to the present invention, it is preferable to render the surface of the photosensitive member to have a property of low surface energy to thereby improve the toner transfer performance from the photosensitive member to a recording material. For achieving this purpose, there are two measures, that is, one measure to cause the surface layer of the photosensitive member to contain fluorine resin particles, and the other measure to supply a surface energy lowering agent to the surface of the photosensitive member for decreasing the surface energy so that the toner transfer performance from the photosensitive member to a recording material can be improved. The synergic effect of lowering the surface energy of the photosensitive member and the use of the series of toners, the turbidities of those which are prepared, makes feasible to provide colored electrophotographic images including images of characters and color images with good definitions and good color reproduction.

Further, it is preferable that the surface energy of the organic photosensitive member according to this invention is lowered so that the surface layer thereof has a contact angle against water of 90 degree or more. When the contact angle against water is rendered at 90 degree or more, not only the performance for cleaning the toners but also the transfer performance from the photosensitive member to a recording material may be improved.

Examples of the fluorine-containing resin particles include such resins in particle form, as poly (tetrafluoroethylene), poly(vinylidene fluoride), poly (ethylene chloride trifluoride), poly(vinyl fluoride), poly (ethylene tetrafluoride)-perfluoroalkylvinyl ether copolymer, poly(ethylenetetrafluoride)-propylenehexafluoride coplymer, polyethylene-ethylene trifluoride copolymer, poly(ehtylene tetrafluoride)-propylene hexafluoride-perfluoroalkylvinyl ether copolymer and the like. The volume-average particle size of the above-enumerated resin is preferably in a range of 0.05 to 10 $\mu$m, and more preferably 0.1 to 5 $\mu$m. The amount of the fluorine-containing resin particles contained in the photosensitive member of this invention is preferably in a range of 0.1 to 90% by mass, and more preferably 1 to 50% by mass with respect to the amount of the binder resin contained in the surface layer of the photosensitive member. If the amount is less than 0.1%, it becomes difficult to provide the photosensitive layer with sufficient resistance to printing and the smoothness. As a result, the degree of improving the primary transfer performance of the toner will be narrowed, and reduction of image density, the transfer errors and deterioration in the image definition tend to be caused easily. On the other hand, if the amount exceeds 90% by mass, the surface layer will become hard to be formed.

Note that the volume-average particle size of the fluorine-containing resin particles is measured by means of a laser diffraction/scattering type particle size distribution analyzer, "LA-700" (manufactured by Horiba Seisakusho Co., Ltd).

Besides, the surface contact angle of the photosensitive member is determined by measuring the contact angle against water with the use of a contact angle meter (CA-DT.A Type: manufactured by Kyowa Kaimen Kagaku Co., Ltd.) under the condition at 20° C. and 50% R. H.

[First Embodiment]

FIG. 1 is a configurative section of a color image forming apparatus representing the first embodiment according to the present invention.

This color image forming apparatus is designated as the tandem-type color image forming apparatus and comprises 4 sets of image forming sections (image forming units) 10Y, 10M, 10C, 10Bk, an endless-belt-shaped intermediate transfer unit 7, a paper supply feeding member 21 and a fixing member 24. Over the main body A of the image forming apparatus, a manuscript image reading apparatus SC is installed.

The image forming unit 10Y for forming images of yellow includes a charging member 2Y arranged around a drum-shaped photosensitive member 1Y functioning as a first image carrier, an exposing member 3Y, a developing member 4Y, a primary transfer roller 5Y as a primary transferring member, and a cleaning member 6Y. The image forming unit 10M for forming images of magenta includes a drum-shaped photosensitive member 1M functioning as a first image carrier, a charging member 2M, an exposing member 3M, a developing member 4M, a primary transfer roller 5M as a primary transferring member, and a cleaning member 6M. The image forming unit 10C for forming images of cyan includes a drum-shaped photosensitive member 1C functioning as a first image carrier, a charging member 2C, an exposing member 3C, a developing member 4C, a primary transfer roller 5C as a primary transferring member, and a cleaning member 6C. The image forming unit 10Bk for forming images of black includes a drum-shaped photosensitive member 1Bk functioning as a first image carrier, a charging member 2Bk, an exposing member 3Bk, a developing member 4Bk, a primary transfer roller 5Bk as a primary transferring member, and a cleaning member 6Bk.

The 4 sets of image forming units 10Y, 10M, 10C and 10Bk each comprise a photosensitive drum 1Y, 1M, 1C, 1K centrally installed, a rotatable charging member 2Y, 2M, 2C. 2K, an image exposing member 3Y, 3M, 3C, 3K, a rotatable developing member 4Y, 4M, 4C, 4K, and a cleaning member 5Y, 5M, 5C, 5K for cleaning the photosensitive drum 1Y, 1M, 1C, 1K, respectively.

Since the image forming units 10Y, 10M, 10C, 10K are different from one another only in their colors to be formed onto the photosensitive members 1Y, 1M, 1C, 1Bk, respectively, but they are configured in the same structure. Therefore, the image forming unit will be described in detail in the following by taking the image forming unit 10Y as the representative example.

The image forming unit 10Y is configured by arranging the charging member 2Y (hereinafter referred to simply as "charging member 2Y" or "electrifier 2Y"), the exposing member 3Y, the developing member 4Y, the cleaning member 5Y (hereinafter referred to simply as "cleaning member 5Y" or "cleaning blade 5Y") around the photosensitive drum 1Y functioning as an image forming body and forms toner images of yellow (Y) on the photosensitive drum 1Y. Besides, in this embodiment, at least the photosensitive drum 1Y, the charging member 2Y, the developing member 4Y and the cleaning member 5Y are integrally configured in the image forming unit 10Y.

The charging member 2Y is a member for providing the photosensitive drum 1Y with even potentials. In this embodiment, a corona discharge type electrifier 2Y is used as the photosensitive drum 1Y.

The image exposing member 3Y is a member to expose light onto the photosensitive drum 1Y having been provided with even potentials in accordance with an image signal (yellow) to thereby form electrostatic latent images corresponding to the images of yellow. As the exposing member 3Y, a member constituted by an LED in which light emitting elements are disposed in an array in the axial direction of the photosensitive drum 1Y and an image formation element (Trade name; Celfox lens), a member of laser optics system or the like may be used.

In the image forming method according to the present invention, it is preferred to carry out image exposure with the use of an exposure beam of which spot area is 2000 $\mu m^2$ or less at the time of forming electrostatic latent images on the photosensitive member. Even though such a beam exposure of a short diameter is applied, the organic photosensitive member according to this invention can authentically form images corresponding to the spot area. Note that the spot area that is more preferred is in a range of 100 to 1000 μm As a result of the use of the beam exposure, it becomes possible to achieve the forming of electrophotographic images with fertile gradation at 800 dpi (dpi denotes the number of dots per 2.54 cm) or more.

Note that the spot area of the exposure beam means the area corresponding to the region having the light intensity of $1/e^2$ or more of the maximum peak intensity in the light intensity distribution plane appeared on the section, when the exposure beam is cut along the plane perpendicular to the beam.

As the light beam to be used here, a scanning optics system using semiconductor laser, a solid-state scanner, such as LED and liquid crystal shutter, or the like may be provided. Also, the light intensity distribution implies the Gauss distribution, the Lorenz distribution and the like. However, in any case, the part being not more than $1/e^2$ of the peak intensity for the respective case is used as the spot area.

The endless-belt-shaped intermediate transfer unit 7 is wound by a plurality of rollers and includes an endless-belt-shaped intermediate transfer member 70, that is rotatably supported, electrically semi-conductive, endless-belt-shaped and operative as a second image carrier.

The images of the respective colors formed by the image forming units 10Y, 10M, 10C, 10Bk are successively transferred onto the rotating endless-belt-shaped intermediate transfer member 70 by means of the primary transfer rollers 5Y, 5M, 5C, 5Bk as the primary transferring member, respectively, and those images are composed to form color images. Papers P as the recording material (a support for carrying fixed finished images: e.g., ordinary papers, transparent sheets, etc.) accommodated in a paper supply cassette 20 are supplied by means of a paper supply member 21, and are fed to a secondary transfer roller 5A as a secondary transferring member through a plurality of intermediate rollers 22A, 22B, 22C, 22D and a resist roller 23, and secondary transfer operation is performed to transfer color images in the block onto the papers P. The papers P to which the color images were transferred are fixed by means of a fixing member 24, and then inserted between paper evacuation rollers 25 so that they are placed on an evacuated paper tray 26 outside the apparatus.

On the other hand, following to the transfer of the color images onto the papers P by means of the secondary transfer roller 5A as the secondary transferring member, the residual toner is removed from the endless-belt-shaped intermediate transfer member 70 having separated the papers P by curvature by means of the cleaning member 6A.

During the image forming process, the primary transfer roller 5Bk is always contacting the photosensitive member 1Bk while applying pressure thereto. Each of the other primary transfer rollers 5Y, 5M, 5C contacts the corresponding photosensitive member 1Y, 1M, 1C while applying pressure thereto only at the time of forming color images.

The secondary transfer roller 5A contacts the endless-belt-shaped intermediate transfer member 70 while applying pressure thereto only during the time that the papers P are passing into the secondary transfer roller 5A and the secondary transfer is performed onto the papers P.

Besides, a case body 8 is formed such that it can be pulled out from the main body A via support rails 82L, 82R.

The case body 8 comprises the image forming sections 10Y, 10M, 10C, 10Bk and the endless-belt-shaped transfer unit 7.

The image forming sections 10Y, 10M, 10C and 10Bk are arranged in a column in the vertical direction. The endless-belt-shaped intermediate transfer unit 7 is arranged in the left side of the photosensitive members 1Y, 1M, 1C and 1Bk in the drawing. The endless-belt-shaped intermediate transfer unit 7 comprises an endless-belt-shaped intermediate transfer member 70 that is wound around the rollers 71, 72, 73, 74 and is rotatable, a primary transfer rollers 5Y, 5M, 5C and 5Bk, and a cleaning member 6A.

Figure 2:
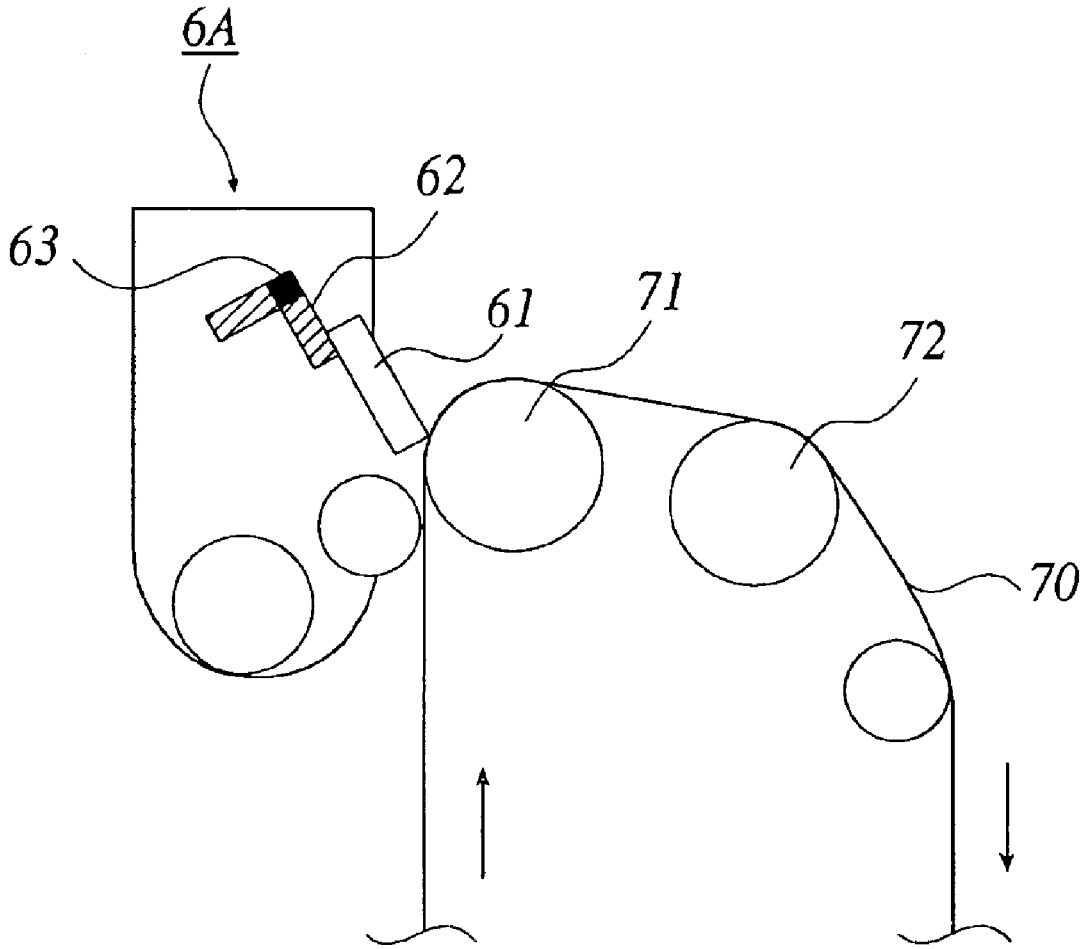
FIG. 2 is a view showing an example of a cleaning member for cleaning an intermediate transfer member.

FIG. 2 shows an example of the cleaning member for cleaning the intermediate transfer member.

As shown in FIG. 2, the cleaning member 6A for cleaning the intermediate transfer member comprises a blade 61 mounted to a bracket 62 rotatably controlled around a support shaft 63. It is configured such that the thrust to the roller 71 can be adjusted by changing a spring load or a weight load.

When the case body 8 is pulled out, the image forming sections 10Y, 10M, 10C, 10Bk and the endless-belt-shaped intermediate transfer unit 7 are integrally pulled out from the main body A.

The support rail 82L located at the left side of the case body 8 in the drawing is arranged in the left of the endless-belt-shaped intermediate transfer member 70 and in the space over the fixing member 24. The support rail 82R located at the right side of the case body 8 in the drawing is arranged in the vicinity of an area beneath the developing member 4Bk locating at the lowest level in the case body. The support rail 82R is arranged at a position at which it does not block the operation to attach or detach the developing member 4Y, 4M, 4C, 4Bk to or from the case body 8.

The right hands of the photosensitive members 1Y, 1M, 1C, 1Bk in the case body 8 in the drawing are surrounded by the developing member 4Y, 4M, 4C, 4Bk, respectively, the undersides of the photosensitive members in the drawing are surrounded by the charging member 2Y, 2M, 2C, 2Bk and the cleaning member 6Y, 6M, 6C, 6Bk, respectively, and the left hands of the photosensitive members in the drawing are surrounded by the endless-belt-shaped intermediate transfer member 70.

In the case body, the photosensitive member, the cleaning member, the charging member, etc. are formed integrally into a photosensitive member unit, and the developing member, the toner supplement unit, etc. are formed into a developing unit.

Figure 3:
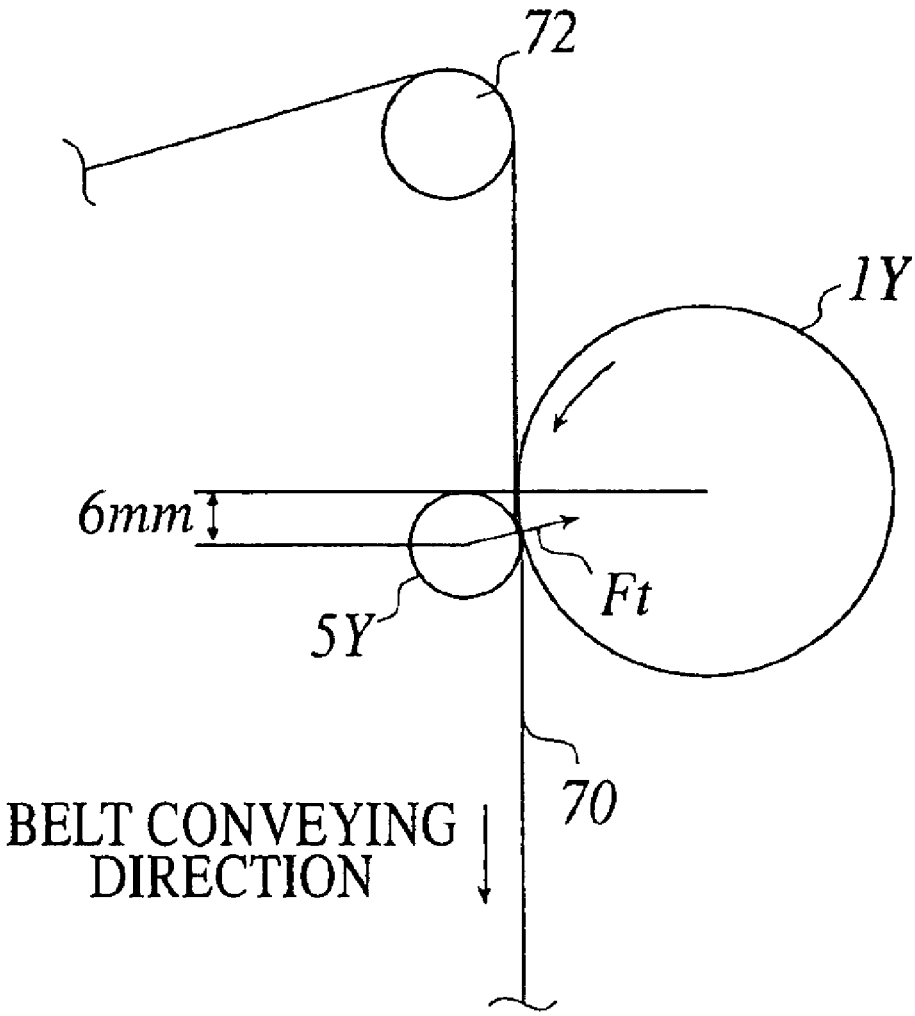
FIG. 3 is an arrangement view showing the positional relation of a photosensitive member, an endless belt-shaped intermediate transfer member and a primary transfer roller.

FIG. 3 is a configurative view showing the positional relation of the endless-belt-shaped intermediate transfer member and the primary transfer roller. The primary transfer rollers 5Y, 5M, 5C, 5Bk are pressed from the backside of the endless-belt-shaped intermediate transfer member 70 as the intermediate transfer member against the photosensitive members 1Y, 1M, 1C, 1Bk, respectively. As shown in FIG. 3, the primary transfer roller 5Y, 5M, 5C, 5Bk is arranged at the downstream side, in the rotating direction of the photosensitive member, from the contact point of the endless-belt-shaped intermediate transfer member 70 as the intermediate transfer member under the state not being pressed and the photosensitive member 1Y, 1M, 1C, 1Bk, respectively, and it is then pressed against the photosensitive member 1Y, 1M, 1C, 1Bk, respectively. At this time, the configuration is changed such that the endless-belt-shaped intermediate transfer member 70 as the intermediate transfer member is bent so as to abut along the outer circumferences of the respective photosensitive members 1Y, 1M, 1C, 1Bk, and the primary transfer rollers 5Y, 5M, 5C, 5Bk are arranged at the most downstream side in the contacting region of the photosensitive members and the endless-belt-shaped intermediate transfer member 70, respectively.

Figure 4:
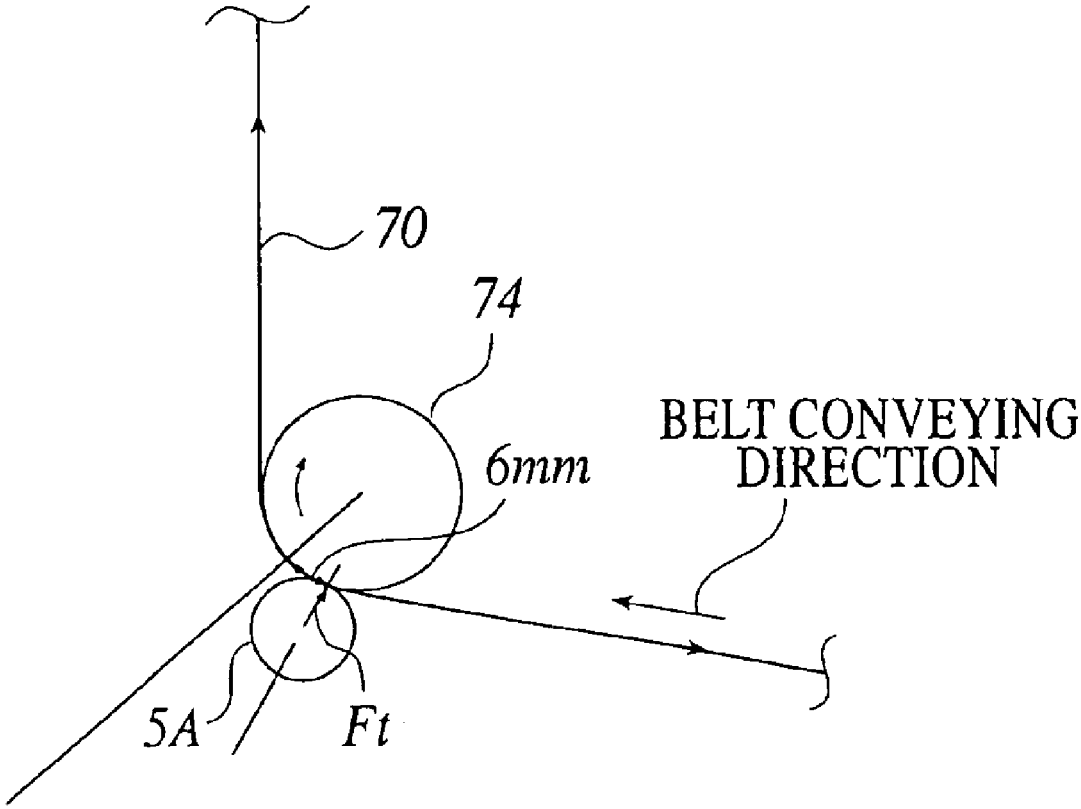
FIG. 4 is an arrangement view showing the positional relation between a backup roller, an intermediate transfer member and a secondary transfer roller.

FIG. 4 is a configurative view showing the positional relation of the backup roller, the endless-belt-shaped intermediate transfer member, and the secondary transfer roller. As shown in FIG. 4, it is desirable that the secondary transfer roller 5A is arranged at the upstream side, in the rotating direction of the backup roller 74, from the center of the contacting portion of the endless-belt-shaped intermediate transfer member 70 as the intermediate transfer member under the state not being pressed by the secondary transfer roller 5A and the backup roller 74.

For the intermediate transfer member 70, a material prepared by adding an electrically conductive filler such as carbon black to a polymer film made of polyamide, polycarbonate, PVdF or the like, or a synthetic rubber, such as silicon rubber and fluorine rubber, to thereby make the material to be electrically conductive, and the like may be used. The shape of the intermediate transfer member may be either drum-shaped or belt-shaped, however, the preferred is the belt-shaped in view of the degree of freedom at designing the apparatus.

In addition, it is preferable that the surface of the intermediate transfer member is appropriately made coarse. By preparing the ten point surface coarseness Rz of the intermediate transfer member at a range of 0.5 to 2 $\mu$m, it comes to be easy to absorb a surface energy lowering agent supplied to the photosensitive member into the surface of the intermediate transfer member, to decrease the adhesion of the toner onto the intermediate transfer member, and to improve transferring efficiency in the secondary transfer of the toner from the intermediate transfer member to the recording material. In this case, there is a tendency that the greater effect can be attained when the ten point surface coarseness Rz of the intermediate transfer member is greater than the ten point surface coarseness Rz of the photosensitive member.

[Second Embodiment]

Now, the color image forming apparatus of a second embodiment according to the present invention will be described in the following. Although the tandem-type image forming apparatus, wherein the photosensitive members 1Y, 1M, 1C, 1Bk as a photosensitive member for electrophotography use were provided for each of the image forming units 10Y, 10M, 10C, 10Bk, respectively, was explained as the example in the first embodiment, an image forming apparatus, wherein a single photosensitive member is provided commonly for four image forming units used for forming black, yellow, magenta and cyans, respectively, is explained as an example in the second embodiment.

Figure 6:
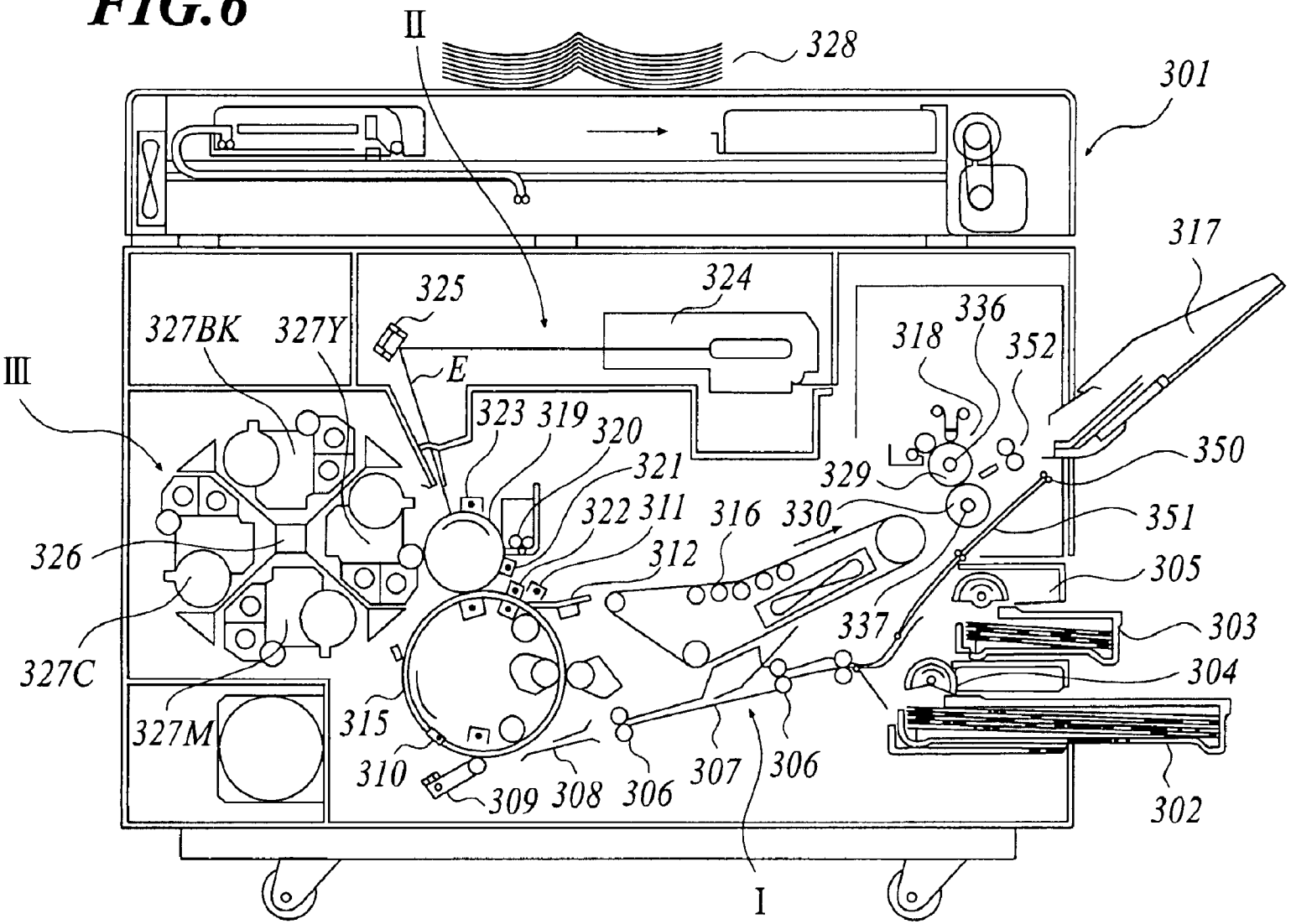
FIG. 6 is a sectional configurative view of the color development forming apparatus of the second embodiment according to the present invention.

FIG. 6 is a configurative section of the color image forming apparatus of the second embodiment. The color image forming apparatus shown in FIG. 6 include, as the main components, a recording material feeding unit I arranged in a region extending from the right hand (right side in FIG. 6) of the apparatus main body 301 up to approximately the central area of the apparatus main body 301, a latent image forming unit II arranged in the vicinity of a transfer drum 315 that constitutes the recording material feeding unit I, and a developing unit III (i.e., rotary-system developing unit) arranged in the vicinity of the latent image forming unit II.

The recording material feeding unit I is configured as described in the following. An opening is formed in the right side wall (right side in FIG. 6) of the apparatus main body 301, and detachable tray 302 and 303 for recording material supply use are attached into the opening such that a part of each of the trays protrudes outside the apparatus. Paper supply rollers 304 and 305 are installed approximately over the trays 302 and 303, respectively, and paper supply rollers 306 and paper supply guides 307, 308 are installed such that they connect the paper supply rollers 304, 305 and the transfer drum 315 arranged in the left hand thereof and rotatable in the direction indicated by an arrow A. In the vicinity of the outer circumferential surface of the transfer drum 315, a contact-forcing roller 309, a gripper 310, an electrifier 311 for recoding material separation, and a separating craw 312 are arranged in this order in a direction of from the upstream side of the rotating direction of the transfer drum 315 to the downstream side of the same.

On the inner circumferential side of the transfer drum 315, a transfer electrifier 313 and an electrifier 314 for recording material separation are arranged. A transfer sheet (not shown) made of a polymer such as poly(vinylidene fluoride) is stuck to the portion of the transfer drum 315 to which the recording material is wound, and the recording material is coherently stuck onto the transfer sheet in virtue of electrostatic force. In the upper area of the right hand space of the transfer drum 315 and in the vicinity of the separating craw 312, a feeding belt 316 is arranged, and a fixing unit 318 is arranged at the terminal end (right hand) of the feeding belt in the direction of feeding the recording material. At the further downstream side from the fixing unit 318 in the feeding direction, an evacuation tray 317 that extends outwardly from the apparatus main body 301 and is attachable to and detachable from the apparatus main body 301 is arranged.

Now, the configuration of the latent image forming unit II will be described below. An amorphous silicon photosensitive drum 319, that is made of an amorphous silicon-based photosensitive material and is a latent image carrier rotatable in the direction indicated by an arrow in FIG. 6, is arranged such that the outer circumference thereof contacts the outer circumference of the transfer drum 315. In the space over the amorphous silicon photosensitive drum 319 and moreover in the vicinity of the outer circumference of the same, an antistatic electrifier 320, a cleaning member 321 and a primary electrifier 323 are arranged in this order in the direction from the upstream side in the rotating direction of the amorphous silicon photosensitive drum 319 to the downstream side of the same, and further, an exposing member 324 like a laser beam scanner for forming electrostatic latent images and an image exposure reflection member 325 like a mirror are arranged onto the outer circumference of the amorphous silicon photosensitive drum 319.

The configuration of the rotary-system developing unit III is as follows. A rotatable case body 326 (hereinafter referred to as "rotating body") is arranged at a position opposing to the outer circumference of the amorphous silicon photosensitive drum 319. In the rotating body 326, four image forming units are mounted at four positions in the circumferential direction, where the latent images formed on the outer circumference surface of the amorphous silicon photosensitive drum 319 are visualized (i.e., developed). The four image forming units include color image developing member, that is, a yellow image developing system 327Y, a magenta image developing system 327M, a cyan image developing system 327C, and black image developing system 327Bk, respectively.

Now, the sequence of the whole image forming apparatus configured as described above will be explained below by taking the full color mode as an example. When the amorphous silicon photosensitive drum 319 rotates in the direction indicated by an arrow in FIG. 6, the photosensitive member on the amorphous silicon photosensitive drum 319 is electrified by the primary electrifier 323. In the apparatus shown in FIG. 6, the operation speed at each unit (hereinafter referred to as "process speed") is 100 mm/sec or faster (e.g., 130 to 250 mm/sec). Following to the completion of electrification applied by the primary electrifier 323 to the amorphous silicon photosensitive drum 319, image exposure operation is carried out with the use of laser beam E having been modulated in accordance with a yellow image signal for the manuscript 328 (first step). Then, electrostatic latent images are formed onto the amorphous silicon photosensitive drum 319, followed by development of the electrostatic latent images by the yellow image developing unit 327Y, that is placed in advance at the developing position in virtue of the rotation of the rotating body 326, whereby images of yellow toner are formed (second step).

The recording material fed through the paper supply guide 307, the paper supply roller 306 and the paper supply guide 308 is retained by the gripper 310 at a predetermined timing and is then electrostatically wound to the transfer drum 315 by the contact-forcing roller 309 and an electrode opposing to the contact-forcing roller 309. During the time when the transfer drum 315 is synchronized with the amorphous silicon photosensitive drum 319 to rotate in the direction indicated by an arrow in FIG. 6, the images of yellow toner formed by the yellow image developing unit 327Y is transferred onto the recording material by the transfer electrifier 313 at the contacting portion of the outer circumference of the amorphous silicon photosensitive drum 319 and the outer circumference of the transfer drum 315. The transfer drum 315 keeps to rotate just like that to be ready for the subsequent color transfer (magenta in FIG. 6).

The amorphous silicon photosensitive drum 319 is destaticized by the antistatic electrifier 320 and cleaned by the cleaning member 321, and it is then electrified again by the primary electrifier 323, followed by the image exposure operation in accordance with magenta image signals, whereby the electrostatic latent images are formed on the amorphous silicon photosensitive drum 319. During the period in which the electrostatic latent images are formed on the amorphous silicon photosensitive drum 319 by the image exposure operation in accordance with the magenta image signals, the rotary-system developing unit rotates to locate the magenta image developing unit 327M at the predetermined position, where the development is carried out with using a given magenta toner. Subsequent thereto, the process same as described above is carried out for cyan (if required, also for black). When the transfer of the toner images of the three colors (or the four colors) ends, the developed images of the three colors formed on the recording material is destaticized by the respective electrifiers 322 and 314. With the release of the holding of the recording material by the gripper 310, the recording material is separated from the transfer drum 315 in virtue of the separating craw 312, and fed to the fixing unit 318 by means of the feeding belt 316, where the images on the recording material is fixed with heat and pressure, and the series of full color printing sequence ends. The desired full color printed images are formed on one side of the surfaces of the recording material.

As described above, although only a single amorphous silicon photosensitive drum 319 is provided commonly for the respective colors in the image forming apparatus of this embodiment, it is possible with the amorphous silicon-based photosensitive member to prevent the dispersion in the quality of color image and the color deviation in color images from occurring, since the turbidity of each color is less than 60, the difference in the turbidities between the respective colors is in a range of 4 to 45 at the maximum, and the image forming unit for black contains a black toner of which turbidity is less than 25.

Besides, when the respective toner images formed on the amorphous silicon photosensitive drum 319 is transferred and the intermediate transfer member for re-transferring the respective transferred toner images onto the recording material is installed, the third step for transferring the toner images formed on the amorphous silicon photosensitive drum 319 to the intermediate transfer member needs to be carried out following to the first and second steps. Further, by repeating the first, second and third steps in this order with using the developing member for the respective color, respectively, color toner images may be formed on the intermediate transfer member.

In addition, in the color image forming method according to the present invention, multicolor images or full color images may be formed by transferring color toner images from the amorphous silicon photosensitive drum 319 to the intermediate transfer member, transferring the color toner images from the intermediate transfer member to the recording material, such as a common paper and a plastic film, and then fixing the color toner images on the recording material.

EXAMPLES

Now, the embodiments according to the present invention will be described specifically in the following. However, the scope of the present invention should not be limited to the description in the following embodiments.

[Preparation of Toners]

(Preparation of Toners 1Bk, 1Ya, 1Yb, 1M and 1C)

Sodium n-dodecylsulfate in an amount of 0.90 Kg was loaded into 10.0 L of pure water and then stirred to dissolve. To this solution was added gradually 1.20 kg of Regal 330R (carbon black, manufactured by Cabott Inc.), and the solution was stirred thoroughly for an hour, and then dispersed continuously for 20 hours by means of a sand grinder (disperser using dispersive medium). The product is provided as "Colorant dispersion solution 1".

A solution consisting of 0.055 kg of sodium dodecylbenzenesulfonate and 4 L of ion-exchanged water is provided as "Anionic surface-active agent solution A".

A solution consisting of 0.014 kg of polyethylene oxide added with 10 moles of nonylphenol and 4.0 L of ion-exchanged water is provided as "Nonionic surface-active agent solution B".

A solution consisting of 223.8 g of potassium persulfate and 12.0 L of ion-exchanged water is provided as "Initiator solution C".

Into a 100 L volume capacity GL (glass-lined) reactor mounted with a temperature sensor, a cooling tube and a nitrogen introduction device were loaded 3.41 kg of WAX emulsion (Polypropylene emulsion of the number-average molecular weight of 3000: Number-average primary particle size, 120 nm; Content of solids, 29.9%), the whole quantity of "Anionic surface-active agent solution A" and the whole quantity of "Nonionic surface-active agent solution B", then starting stirring. Following thereto, 44.0 L of ion-exchanged water was added.

Heating was started, and the whole quantity of. "Initiator solution C" was started to add by dropping when the temperature of the solution was elevated to reach 75° C. Then, 12.1 kg of styrene, 2.88 kg of n-butyl acrylate, 1.04 kg of metacrylic acid and 548 g of t-dodecylmercaptan were loaded by dropping while controlling the temperature of the solution at a range of 75±1° C. Following to the dropping, the temperature of the solution was elevated up to 80±1° C., and stirred for 6 hours while heating. Then, the temperature of the solution was cooled to 40° C. or lower, the stirring was discontinued, and the solution was filtered with a pole filter to give a latex. This latex is provided as "Latex-A".

Note that the glass transition temperature of the resin particles in the Latex-A was 57° C., the softening point thereof was 121° C., and with regards to the molecular weight distribution thereof, the weight-average molecular weight was 12,700 and the weight-average particle size was 120 nm.

A solution consisting of 0.055 kg of sodium dodecylbenzenesulfonate and 4.0 L of ion-exchanged water is provided as "Anionic surface-active agent solution D".

Furthermore, a solution consisting of 0.014 kg of polyethylene oxide added with 10 moles of nonylphenol and 4.0 L of ion-exchanged water is provided as "Nonionic surface-active agent solution E".

A solution consisting of 200.7 g of potassium persulfate (manufactured by Kanto Kagaku Co., Ltd.) and 12.0 L of ion-exchanged water is provided as "Initiator solution F".

Into a 100 L capacity GL reactor mounted with a temperature sensor, a cooling tube, a nitrogen introduction device and a comb-shaped baffle were loaded 3.41 kg of WAX emulsion (Polypropylene emulsion of the number-average molecular weight of 3000: Number-average primary particle size, 120 nm; Content of solids, 29.9%), the whole quantity of "Anionic surface-active agent solution D" and the whole quantity of "Nonionic surface-active agent solution E", then starting stirring.

Then, 44.0 L of ion-exchanged water was loaded. Heating was started, and the whole quantity of "Initiator solution F" was started to add when the temperature of the solution was elevated to reach 70° C. Then, a solution consisting of 11.0 kg of styrene, 4.00 kg of n-butyl acrylate, 1.04 kg of metacrylic acid and 9.02 g of t-dodecylmercaptan prepared in advance was loaded by dropping. Following to the dropping, the temperature of the solution was controlled in a temperature range of 72±2° C., and the solution was stirred for 6 hours while heating. Then, the temperature of the solution was further elevated up to 80±2° C. and stirred for 12 hours under heating. The temperature of the solution was cooled to 40° C. or lower, the stirring was discontinued, and the solution was filtered with a pole filter to give the filtrate. This filtrate is provided as "Latex-B".

Note that the glass transition temperature of the resin particles in the Latex-B was 58° C., the softening point thereof was 132° C., and with regards to the molecular weight distribution thereof, the weight-average molecular weight was 245,000 and the weight-average particle size was 110 nm.

A solution consisting of 5.36 g of sodium chloride as a salting-out agent and 20.0 L of ion-exchanged water is provided as "Sodium chloride solution G".

A solution consisting of 1.00 g of fluorine-containing nonionic surface-active agent and 1.00 L of ion-exchanged water is provided as "Nonionic surface-active agent solution H".

Into a 100 L capacity SUS reactor mounted with a temperature sensor, a cooling tube, a nitrogen introduction device and a device for monitoring particle size and shape of the particles were loaded 20.0 kg of the above-prepared Latex-A, 5.2 kg of the above-prepared Latex-B, 0.4 kg of the colorant dispersion solution 1, and 20.0 kg of ion-exchanged water, then stirring the solution. Then, the solution was heated up to 40° C. and added with the whole quantity of "Sodium chloride solution G", 6.00 kg of isopropanol (manufactured by Kanto Kagaku Co., Ltd.) and the whole quantity of "Nonionic surface-active agent solution H" in this order. Then, the solution was left for 10 min as it is, followed by starting of heating. The temperature of the solution was elevated by heating up to 85° C. over 60 min, and stirred under heating for 0.5 to 3 hours at a temperature of 85±2° C. to grow the particle size while causing the salting-out/fusion-adherence (Salting-out/fusion-adherence step). Then, the solution was added with 2.1 L of pure water to discontinue the growth of the particle size so that the dispersion solution of the fusion-adhered particles is prepared.

Into a 5 L capacity reactor mounted with a temperature sensor, a cooling tube, and a device for monitoring particle size and shape of the particles was loaded 5.0 kg of the fusion-adhered particles dispersion solution prepared as described above, and the solution was stirred under heating at a temperature of 85±2° C. for 0.5 to 15 hours to control of shape of the particles (Shape control step). Then, the solution was cooled to 40° C. or lower followed by discontinuing of the stirring. Then, classification of the solution was carried out by means of a centrifuge, filtrated with a sieve with 45 μm mesh. The filtrate is provided as the association solution. Then, a Nutsche was used to take out the non-spherical particles in a sate of wet cake by filtration from the association solution. Then, the particles were washed with ion-exchanged water. The non-spherical particles were dried by means of a flash jet drier at a suction temperature of 60° C., and further dried by means of a fluid layer drier at 60° C. To 100 parts by mass of the obtained colorant particles were added 0.5 parts by mass of hydrophobic silica (the degree of hydrophobization is 75, the number-average primary particle size is 12 nm), and 0.25 parts by mass of titanium oxide with the particle size of 0.05 μm, and the mixture was mixed for 10 min at 52° C. by means of Hanschel mixer at the circumferential speed of 40 m/s to give "Toner 1Bk".

"Toner 1Ya" was obtained according to the same process for preparing the toner 1Bk, except replacing carbon black by C.I. pigment yellow 185. Further, "Toner 1Yb" was obtained according to the same process, except reducing the circumferential speed of Henschel mixer a little.

"Toner 1M" was obtained according to the same process for preparing the toner 1Bk, except replacing carbon black by C.I. pigment red 122.

"Toner 1C" was obtained according to the same process for preparing the toner 1Bk, except replacing carbon black by C.I. pigment blue 15:3. The number-average particle sizes of the toners 1Bk, 1Ya, 1M, and 1C, and the results of measurements of $M(m_1+m_2)$ are shown in Table 1, and the results of measurements of the toner turbidity is shown in Table 3. Besides, it was found that the number-average particle size and $M(m_1+m_2)$ of the toner 1Yb were almost same as those of the toner 1Ya.

(Preparation of Toners 2Bk, 2Ya through 2Yf, 2M and 2C)

The toners 2Bk, 2Ya through 2Yf, 2M and 2C were prepared according to the same process described above for preparing the toners 1Bk, 1Ya, 1M and 1C, except replacing the hydrophobic silica (the degree of hydrophobization is 75, the number-average primary particle size is 12 nm) by hydrophobic silica (the degree of hydrophobization is 77, the number-average primary particle size is 20 nm), and changing the circumferential speed of Henschel mixer and the mixing period of time. The results of measurements for the turbidities of the toners 2Bk, 2Ya through 2Yf, 2M and 2C are shown in Table 3. Note that the number-average particle sizes and the values of $M(m_1+m_2)$ of these toners were in principle same as the measurement results of the number-average particle sizes and the values of $M(m_1+m_2)$ of the corresponding toners 1Bk, 1Ya, 1M and 1C, respectively.

(Preparation of Toners 3Bk, 3Ya through 3Yd, 3M and 3C)

The toners 3Bk, 3Ya through 3Yd, 3M and 3C were prepared according to the same process described above for preparing the toners 1Bk, 1Ya, 1M and 1C, except replacing 0.5 parts by mass of the hydrophobic silica (the degree of hydrophobization is 75, the number-average primary particle size is 12 nm) by 1.8 parts by mass thereof, and changing the circumferential speed of Henschel mixer and the mixing period of time. The results of measurements for the turbidities of the toners 3Bk, 3Ya through 3Yd, 3M and 3C are shown in Table 3. Note that the number-average particle sizes and the values of $M(m_1+m_2)$ of these toners were in principle same as the measurement results of those of the corresponding toners 1Bk, 1Ya, 1M and 1C, respectively.

(Preparation of Toners 4Bk, 4Ya through 4Yc, 4M and 3C)

The toners 4Bk, 4Ya through 4Yc, 4M and 4C were prepared according to the same process described above for preparing the toners 1Bk, 1Ya, 1M and 1C, except replacing 0.5 parts by mass of the hydrophobic silica (the degree of hydrophobization is 75, the number-average primary particle size is 12 nm) by 1.8 parts by mass of hydrophobic silica (the degree of hydrophobization is 77, the number-average primary particle size is 20 nm), and changing the circumferential speed of Henschel mixer and the mixing period of time. The results of measurements for the turbidities of the toners 4Bk, 4Ya through 4Yc, 4M and 4C are shown in Table 3. Note that the number-average particle sizes and the values of $M(m_1+m_2)$ of these toners were in principle same as the measurement results of those of the corresponding toners 1Bk, 1Ya, 1M and 1C, respectively.

(Preparation of Toners 5Bk, 5Y, 5Ma through 5Mc and 5C)

The toners 5Bk, 5Y, 5Ma through 5Mc and 5C were prepared according to the same process described above for preparing the toners 1Bk, 1Ya, 1M and 1C, except replacing 0.5 parts by mass of the hydrophobic silica (the degree of hydrophobization is 75, the number-average primary particle size is 12 nm) by 3.3 parts by mass of hydrophobic silica (the degree of hydrophobization is 77, the number-average primary particle size is 20 nm), and changing the circumferential speed of Henschel mixer and the mixing period of time. The results of measurements for the turbidities of the toners 5Bk, 5Y, 5Ma through 5Mc and 5C are shown in Table 3. Note that the number-average particle sizes and the values of $M(m_1+m_2)$ of these toners were in principle same as the measurement results of those of the corresponding toners 1Bk, 1Ya, 1M and 1C, respectively.

(Preparation of Toners 6Bk, 6Y, 6M and 6Ca through 6Cc)

The toners 6Bk, 6Y, 6M and 6Ca through 6Cc were prepared according to the same process described above for preparing the toners 1Bk, 1Ya, 1M and 1C, except changing the circumferential speed of Henschel mixer and the mixing period of time. The results of measurements for the turbidities of the toners 6Bk, 6Y, 6M and 6Ca through 6Cc are shown in Table 3. Note that the number-average particle sizes and the values of $M(m_1+m_2)$ of these toners were in principle almost same as the measurement results of those of the corresponding toners 1Bk, 1Ya, 1M and 1C, respectively.

TABLE 1

| Toner No. | Number-average Particle Size of Toner ($\mu$m) | M ($m_1$ + $m_2$) (%) |
|---|---|---|
| 1Bk | 5.6 | 80.7 |
| 1Ya | 5.7 | 78.8 |
| 1M | 5.6 | 81.3 |
| 1C | 5.6 | 80.3 |

[Preparation of Developer]

The developers 1Bk through 1C, the developers 2Bk through 2C, the developers 3Bk through 3C, the developers 4Bk through 4C, the developers 5Bk through 5C, and the developers 6Bk through 6C, all of those which are for evaluations, were prepared by mixing 10 parts by mass of the respective toners, that is, toners 1Bk through 1C, toners 2Bk through 2C, toners 3Bk through 3C, toners 4Bk through 4C, toners 5Bk through 5C, and toners 6Bk through 6C, and 100 parts by mass of ferrite carrier coated with styrene-metacrylate copolymer and having a particle size of 45 $\mu$m.

[Preparation of Photosensitive Member]

The photosensitive members to be used in the embodiments were prepared as follows.

Preparation of Photosensitive Member 1 (Organic Photosensitive Member):

An intermediate layer coating solution described below was prepared and applied onto a washed cylinder-shaped aluminum-made base body having a diameter of 40 mm in accordance with the dip coating method to form the intermediate layer with the dried film thickness of 0.3

<Intermediate Layer (UCL) Coating Solution>

| | |
|---|---|
| Polyamide resin<br>(Amilan CM-8000; Manufactured by Toray Co., Ltd.) | 60 g |
| Methanol | 1600 ml |

A coating solution for coating the charge generating layer was prepared by mixing the components for the coating solution mentioned below and dispersing the components for 10 hours by means of a sand grinder. This coating solution was applied onto the intermediate layer in accordance with the dip coating method to form the charge generating layer having the dried film thickness of 0.2 $\mu$m on the intermediate layer.

<Charge Generating Layer (CGL) Coating Solution>

| | |
|---|---|
| Y-type titanylphthalocyanine<br>(Titanylphthalocyanine pigment of which maximum peak angle of X-ray diffraction spectrum using Cu-K$\alpha$ characterized X-rays at 2$\theta$ is 27.3) | 60 g |
| Silicon resin solution<br>(KR5240, 15% xylene-butanol solution; Manufactured by Shinetsu Kagaku Co., Ltd.) | 700 g |
| 2-Butanone | 2000 ml |

A coating solution for the charge transporting layer was prepared by mixing and dissolving the components of the coating solution listed below. The coating solution was applied onto the charge transporting layer in accordance with the dip coating method to form the charge transporting layer having the film thickness of 20 $\mu$m.

<Charge Transporting Layer (CTL) Coating Solution>

| | |
|---|---|
| Charge transporting material, 4-methosy-4'-(4-methyl-α-phenylstyryl)triphenylamine | 200 g |
| Bisphenol-Z-type polycarbonate (Upilon Z300; Manufactured by Mitsubishi Gas Chemical Co., Ltd.) | 300 g |
| Hindered amine (Sanol LS2626; Manufactured by Sankyo Co. Ltd.) | 3 g |
| 1,2-Dichloroethane | 2000 ml |

Preparation of Photosensitive member 2 (Organic photosensitive member having a surface protection layer containing fluorine-containing resin particles)

According to the above-described processes for preparing the photosensitive member 1, the intermediate layer coating solution, the charge generating layer coating solution and the charge transporting layer coating solution for the photosensitive member 2 were prepared.

<Surface Protection Layer>

| | |
|---|---|
| Charge transporting material, 4-methoxy-4'-(4-methyl-α-phenylstyryl)triphenylamine | 200 g |
| Bisphenol-Z-type polycarbonate (Upilon Z300; Manufactured by Mitsubishi Gas Chemical Co., Ltd.) | 300 g |
| Hindered amine (Sanol LS2626; Manufactured by Sankyo Co., Ltd.) | 3 g |
| Colloidal silica (30% methanol solution) | 8 g |
| Polytetrafluoroethylene resin particles (Average particle size of 0.5 μm) | 100 g |
| 1-Butanol | 2000 ml |

The components listed above were mixed and dissolve to prepare the coating solution for the surface protection layer. The coating solution was applied onto the charge transporting layer in accordance with the dip coating method and then subjected to heat curing for 40 min at 100° C. to form the surface protection layer with the dried film thickness of 4 μm, and accordingly the photosensitive member 2.

Preparation of Photosensitive Member 3 (a-Si Photosensitive Member)

Employing the manufacturing process for photosensitive member used for the image forming apparatus using the known RF-PCVD process disclosed in Japanese Patent Laid-open No. 2002-372820, etc., a negatively electrified photosensitive member was formed on an aluminum-made cylinder applied with mirror surface of 40 mm diameter under the conditions indicated in Table 2.

TABLE 2

| | Charge Injection Inhibiting Layer | Photo-con-ductive Layer | Inter-mediate Layer | Surface Layer |
|---|---|---|---|---|
| Gas type and Flow rate | | | | |
| $SiH_4$[$cm^3$/min (normal)] | 160 | 200 | 100 | 10 |
| $H_2$[$cm^3$/min (normal)] | 500 | 800 | | |
| $PH_3$[ppm] (relative to $SiH_4$) | 1000 | | | |
| $B_2H_5$[ppm] (relative to $SiH_4$) | | 0.5 | 500 | |
| $CH_4$[$cm^3$/min (normal)] | 20 | | 300 | 480 |
| Support Temperature [° C.] | 260 | 260 | 260 | 260 |
| Inner Pressure [Pa] | 40 | 40 | 27 | 13 |
| RF Power [W] | 300 | 600 | 300 | 200 |
| Film Thickness [μm] | 2 | 30 | 0.1 | 0.5 |

Example 1

<Evaluation>

In the following evaluations and comparisons, monochromic images containing both characters with the pixel ratio of 8% and half tone and color images were continuously printed on 50,000 sheets of A4 size with the use of the photosensitive groups and the developer groups (toner groups) composed as shown in Table 3 by means of a digital copying machine mounted with the image forming apparatus of the first embodiment including the respective image forming units of Y (yellow), M (magenta), C (cyan) and Bk (black) and the intermediate layer shown in FIG. 2 at a normal temperatures and humidity (20° C., 50% RH). The ratio of the monochromic images to the color images to print was fixed to a ratio of 9:1, that is, 9 sheets of monochromic images relative to one sheet of color images, in view of taking the printing ratio of monochromic and color images printed by the tandem-type color image forming apparatus into consideration. However, the printing was temporarily discontinued upon requirements for the following evaluation. The objective items, methods and criteria for the evaluations are described in the following. The details of combinations of the photosensitive members and the toners are shown in Table 3.

TABLE 3

| Combi-nation No. | Photosensitive Member Group No. | Developer Group (Toner Group) No. | Developer (BK) No. = Toner (BK) No. | | Developer (Y) No. = Toner (Y) No. | | Developer (M) No. = Toner (M) No. | | Developer (C) No. = Toner (C) No. | | Difference in Turbidity (Max − Min) | Remarks |
|---|---|---|---|---|---|---|---|---|---|---|---|---|
| | | | Toner No. | Turbidity | Toner No. | Turbidity | Toner No. | Turbidity | Toner No. | Turbidity | | |
| 1 | 1 | 1 | 1Bk | 6.2 | 1Ya | 10.3 | 1M | 6.6 | 1C | 6.4 | 4.1 | Out of the Invention |
| 2 | 2 | 2 | 1Bk | 6.2 | 1Yb | 11.4 | 1M | 6.6 | 1C | 6.4 | 5.2 | Within the Invention |
| 3 | 1 | 3 | 2Bk | 12.5 | 2Ya | 18.3 | 2M | 12.0 | 2C | 11.3 | 7.0 | Within the Invention |
| 4 | 2 | 4 | 2Bk | 12.5 | 2Yb | 22.1 | 2M | 12.0 | 2C | 11.3 | 10.8 | Within the Invention |
| 5 | 1 | 5 | 2Bk | 12.5 | 2Yc | 35.3 | 2M | 12.0 | 2C | 11.3 | 24.0 | Within the Invention |
| 6 | 2 | 6 | 2Bk | 12.5 | 2Yd | 46.0 | 2M | 12.0 | 2C | 11.3 | 34.7 | Within the Invention |
| 7 | 1 | 7 | 2Bk | 12.5 | 2Ye | 55.1 | 2M | 12.0 | 2C | 11.3 | 43.8 | Within the Invention |

TABLE 3-continued

| Combination No. | Photosensitive Member Group No. | Developer Group (Toner Group) No. | Developer (BK) No. = Toner (BK) No. Toner No. | Turbidity | Developer (Y) No. = Toner (Y) No. Toner No. | Turbidity | Developer (M) No. = Toner (M) No. Toner No. | Turbidity | Developer (C) No. = Toner (C) No. Toner No. | Turbidity | Difference in Turbidity (Max − Min) | Remarks |
|---|---|---|---|---|---|---|---|---|---|---|---|---|
| 8 | 2 | 8 | 2Bk | 12.5 | 2Yf | 58.3 | 2M | 12.0 | 2C | 11.3 | 47.0 | Out of the Invention |
| 9 | 1 | 9 | 3Bk | 18.5 | 3Ya | 33.4 | 3M | 19.3 | 3C | 23.8 | 14.9 | Within the Invention |
| 10 | 2 | 10 | 3Bk | 18.5 | 3Yb | 46.0 | 3M | 19.3 | 3C | 23.8 | 27.5 | Within the Invention |
| 11 | 1 | 11 | 3Bk | 18.5 | 3Yc | 56.8 | 3M | 19.3 | 3C | 23.8 | 38.3 | Within the Invention |
| 12 | 2 | 12 | 3Bk | 18.5 | 3Yd | 63.3 | 3M | 19.3 | 3C | 23.8 | 44.8 | Out of the Invention |
| 13 | 1 | 13 | 4Bk | 22.3 | 4Ya | 33.8 | 4M | 29.3 | 4C | 30.5 | 11.5 | Within the Invention |
| 14 | 2 | 14 | 4Bk | 22.3 | 4Yb | 55.6 | 4M | 29.3 | 4C | 30.5 | 33.3 | Within the Invention |
| 15 | 1 | 15 | 4Bk | 22.3 | 4Yc | 62.2 | 4M | 29.3 | 4C | 30.5 | 39.9 | Out of the invention |
| 16 | 2 | 16 | 5Bk | 31.5 | 5Y | 35.6 | 5Ma | 33.2 | 5C | 44.7 | 13.2 | Out of the Invention |
| 17 | 1 | 17 | 5Bk | 31.5 | 5Y | 35.6 | 5Mb | 55.1 | 5C | 44.7 | 23.6 | Out of the Invention |
| 18 | 2 | 18 | 5Bk | 31.5 | 5Y | 35.6 | 5Mc | 63.3 | 5C | 44.7 | 31.8 | Out of the Invention |
| 19 | 1 | 19 | 6Bk | 6.4 | 6Y | 7.3 | 6M | 5.3 | 6Ca | 12.1 | 6.8 | Within the Invention |
| 20 | 2 | 20 | 6Bk | 6.4 | 6Y | 7.3 | 6M | 5.3 | 6Cb | 23.4 | 18.1 | Within the Invention |
| 21 | 1 | 21 | 6Bk | 6.4 | 6Y | 7.3 | 6M | 5.3 | 6Cc | 52.4 | 47.1 | Out of the Invention |
| 22 | 3 | 3 | 2Bk | 12.5 | 2Ya | 18.3 | 2M | 12.0 | 2C | 11.3 | 7.0 | Out of the Invention |
| 23 | 3 | 9 | 3Bk | 18.5 | 3Ya | 33.4 | 3M | 19.3 | 3C | 23.8 | 14.9 | Out of the Invention |

In Table 3, the photosensitive member groups, 1, 2 and 3 are composed by using the photosensitive members for each of Y, M, C and Bk in accordance with the combinations shown in Table 4

TABLE 4

| Photosensitive Member Group No. | For Bk | For Y | For M | For C |
|---|---|---|---|---|
| 1 | Photosensitive Member 3 | Photosensitive Member 1 | Photosensitive Member 1 | Photosensitive Member 1 |
| 2 | Photosensitive Member 3 | Photosensitive Member 2 | Photosensitive Member 2 | Photosensitive Member 2 |
| 3 | Photosensitive Member 1 | Photosensitive Member 1 | Photosensitive Member 1 | Photosensitive Member 1 |

Objective Items, Methods and Criteria for Evaluations "Dot Reproducibility of Monochromic Images"

The dot reproducibility constituting a black image was evaluated by means of a magnifier with the power of 100 times. The evaluation was made with black images on sheets obtained following to the completion of 50,000 sheets printing.

◎: Image dots are formed with the deviation of less than 30% relative to an exposure spot area, and the dots are each independently reproduced. (Good)

○: Image dots are formed with the deviation of 30 to 60% relative to an exposure spot area, and the dots are each independently reproduced. (Acceptable level for practical use)

X: Image dots are formed with the deviation exceeding 60% relative to an exposure spot area, and the dots are partly disappeared or jointed. (Problematic level for practical use)

"Dot Reproducibility of Color Image"

The dot reproducibility constituting an image was evaluated by means of a magnifier with the power of 100 times. The evaluation was made with color images on sheets obtained following to the completion of 50,000 sheets printing.

◎: Color images are reproduced with less dispersion between dots for each color of Bk, Y, M and C (difference between the maximum and the minimum in the dot sizes is less than 30% in terms of the dot area difference) and with good color balance. (Good)

○: Color images are reproduced such that the dispersion between dots for each color of Bk, Y, M and C in the reproduced color images, that is, difference between the maximum dots and the minimum dots in size for each color is 30 to 60% in terms of the dot area difference, and color images are reproduced with good color balance. (Acceptable level for practical use)

X: Dispersion between dots for the respective colors of Bk, Y, M and C in reproduced color images is greater, that is, difference between the maximum dots and the minimum dots in size for the respective color is more than 60% in terms of the dot area difference, and the color balance in the reproduced color images has been lost. (Problematic level for practical use)

"Transfer Errors"

Half tone images with density of 0.4 were formed on a paper (basis weight: 200 g/m$^2$), and the occurrence of white spots due to the transfer errors was visually checked.

◎◎: No transfer error (No occurrence of white spot) (Excellent)

◎: Transfer errors at a rate of 1 or 2 per 100 sheets of images were recognized, but they are not recognizable without stares. (Good)

○: Transfer errors at a rate of 1 or 4 per 50 sheets of images were recognized, but they are not recognizable without stares. (Practically acceptable)

X: Distinctive transfer errors were recognized at a rate of 5 or more per 100 sheets of images. (Practically problematic)

"Black Spots"

The evaluation was carried out by checking the number of black spots (strawberry-shaped spot images) with a cycle that accords to the cycle of the photosensitive member in half tone images formed on a paper of A4 size.

◎: Frequency of occurrence of black spots with a size of greater than 0.4 mm: All copied images respectively contain 3 spots or less per an A4 sheet (Good).

○: Frequency of occurrence of black spots with a size of greater than 0.4 mm: All copied images respectively contain 4 or more spots per an A4 sheet, and 1 or more sheets contain 15 or less spots per an A4 sheet (Practically acceptable).

X: Frequency of occurrence of black spots with a size of greater than 0.4 mm: One or more sheets contain 16 or more spots per an A4 sheet (Practically problematic).

"Image Density"

Measurements of the image density were made by measuring the densities of the printed solid portions with the respective colors by means of a density meter, "RD-918" (manufactured by Macbeth Inc.), and the density was expressed by the relative reflection density when the density of the used paper is fixed to zero.

◎: Density of each of the solid image portions formed with Bk and those with Y, M and C is 1.2 or more (Good).

○: Density of each of the solid image portions formed with Bk and those of Y, M, and C is 0.8 or more (Practically acceptable).

X: Density of each of the solid image portions formed with Bk and those of Y, M, and C is less than 0.8 (Practically problematic).

"Image Definition"

The definition of images was evaluated from collapses of characters following to forming images under both low temperature and low humidity condition (10° C., 20% RH) and high temperature and high humidity condition (30° C., 80% RH). Images of characters with sizes of 3 point and 5 point were formed, and these images were checked according to the following criterion.

◎: Images of both 3 point and 5 point characters are clear and easily readable.

○: Images of 3 point characters are partly unreadable, but images of 5 point characters are clear and easily readable.

X: Images of 3 point characters are mostly unreadable, and images of 5 point characters are partly or mostly unreadable.

Process Conditions for Digital Copying Machine including Intermediate transfer member:

Line speed L/S for image forming/S: 180 mm/s

Condition for photosensitive member electrification: The potentials on the non-image portions were sensed with a potential sensor and made to be feedback-controllable. An electrification potential of −400V was applied to the amorphous silicon photosensitive member, and the same of −750V was applied to the organic photosensitive member. The surface potential of the photosensitive member when the whole thereof was exposed is fixed to a potential in a range of −50 to 0V.

Condition for image exposure: Semiconductor laser, Exposure spot area: $7.5\times10^{-10}$ $m^2$, 80 dpi Intermediate transfer member: Endless-belt-shaped seamless intermediate transfer member made of a electrically semi-conductive resin having a volume resistance rate of $1\times10^8$ Ω and Rz of 0.9 μm was used.

[Primary Transfer Condition]

Primary transfer roller (5Y, 5M, 5C, 5Bk in FIG. 1, Diameter: Each has 6.05 mmϕ): Each roller is configured such that an elastic rubber is applied to a metal center. Surface specific resistance, $1\times10^6$ Ω, Transfer voltage energized.

[Secondary Transfer Condition]

The backup roller 74 and the secondary transfer roller 5A are arranged such that they sandwich the endless-belt-shaped intermediate transfer member 70 functioning as the intermediate transfer member. The resistance of the backup roller 74 is $1\times10^6$ Ω, and the resistance of the secondary transfer roller functioning as the secondary transfer member is $1\times10^6$ Ω, and constant current control (at approximately 80 μA) is applied.

The fixing is carried out according to the heat fixing method with the use of a fixing roller in which a heater is installed.

The distance Y on the intermediate transfer member from the first contacting point of the intermediate transfer member and the photosensitive member to the first contacting point of the intermediate transfer member and the photosensitive member for the next color is fixed to 95 mm.

The length of each of the outer circumferences (circle length) of the driving roller 71, the guide rollers 72, 73 and the backup roller 74 for the secondary transfer is fixed to 31.67 mm (=95 mm/3), and the length of the outer circumference of the tension roller 76 is fixed to 23.75 mm (=95 mm/4).

Further, the length of the outer circumference of the primary transfer roller is fixed to 19 mm (=95 mm/5).

[Conditions for Cleaning Photosensitive Member]

Cleaning blade: An urethane rubber blade was arranged in the rotating direction of the photosensitive member so as to contact the photosensitive member in the counter manner.

[Conditions for Cleaning Intermediate Transfer Member]

Cleaning blade: An urethane rubber blade was arranged in the advance direction of the intermediate transfer member so as to contact the intermediate transfer member in the counter manner. The results are shown in Table 5.

TABLE 5

| Combination No. | Dot Reproducibility of Monochromic Image | Dot Reproducibility of color Image | Transfer Error | Black Spot | Image Density | Definition | Remarks |
|---|---|---|---|---|---|---|---|
| 1 | ○ | ○ | X | ○ | X | X | Out of the Invention |
| 2 | ◎ | ○ | ○ | ○ | ○ | ○ | Within the Invention |
| 3 | ◎ | ○ | ○ | ◎ | ○ | ◎ | Within the Invention |
| 4 | ◎ | ◎ | ◎◎ | ◎ | ◎ | ◎ | Within the Invention |
| 5 | ◎ | ◎ | ◎ | ◎ | ◎ | ◎ | Within the Invention |
| 6 | ◎ | ◎ | ◎◎ | ◎ | ◎ | ◎ | Within the Invention |
| 7 | ◎ | ○ | ◎ | ○ | ◎ | ○ | Within the Invention |
| 8 | ○ | X | ○ | ○ | ○ | X | Out of the Invention |
| 9 | ◎ | ◎ | ◎ | ◎ | ◎ | ◎ | Within the Invention |
| 10 | ◎ | ◎ | ◎◎ | ◎ | ◎ | ◎ | Within the Invention |
| 11 | ◎ | ◎ | ◎ | ○ | ◎ | ○ | Within the Invention |
| 12 | ○ | X | ○ | X | ○ | X | Out of the Invention |
| 13 | ○ | ◎ | ◎ | ◎ | ◎ | ◎ | Within the Invention |
| 14 | ○ | ○ | ◎ | ○ | ◎ | ◎ | Within the Invention |
| 15 | ○ | X | ○ | X | ○ | X | Out of the Invention |
| 16 | X | X | ◎ | ○ | ◎ | X | Out of the Invention |

TABLE 5-continued

| Combination No. | Dot Reproducibility of Monochromic Image | Dot Reproducibility of color Image | Transfer Error | Black Spot | Image Density | Definition | Remarks |
|---|---|---|---|---|---|---|---|
| 17 | X | X | ◎ | ○ | ◎ | X | Out of the Invention |
| 18 | X | X | ○ | X | X | X | Out of the Invention |
| 19 | ◎ | ○ | ○ | ◎ | ◎ | ○ | Within the Invention |
| 20 | ◎ | ◎ | ◎◎ | ◎ | ◎ | ◎ | Within the Invention |
| 21 | ○ | X | ○ | ○ | ○ | X | Out of the Invention |
| 22 | X | X | ◎ | ◎ | ○ | X | Out of the Invention |
| 23 | X | X | ○ | ○ | ○ | X | Out of the Invention |

As shown in Table 5, the combinations of the tosensitive member groups and the developer groups mplying with the requirements of the present invention, t is, the combinations Nos. 2, 3, 4, 5, 6, 7, 9, 10, 13, 14, 19 and 20, those which are combinations of photosensitive member groups 1 and 2 and the developer groups with each of which the turbidity of black toner is less than 25 and the difference in the turbidities between the respective color toners is in a range of 5 to 45 at the maximum, have achieved to obtain good evaluation results more than the practical requirements in terms of the dot reproducibility of monochromic and color images, the transfer error, the black spots, the image density and the image definition. On the other hand, in the combinations Nos. 1, 8, 12, 15, 16, 17, 18, 21, 22 and 23, those which use the photosensitive member groups 1 and 2 according to this invention but use the developer groups out of this invention, the fluidity of the toner is not sufficient in case of the combination No. 1 with the difference in the turbidity between the respective color toners of 4.1, and therefore, the results for the transfer error, the image density and the image definition were inferior. The combinations Nos. 8 and 21 each with the difference in the turbidity of 47 something showed the inferior dot reproducibility of color images and deterioration in the image definition due to the unstable balance in the quantity of electrification. Also, in case of the combinations Nos. 12, 15 and 18, wherein the developer group with which the turbidity of any of the color toners becomes 60 or more is used, the free external additives came to be excessive in their quantities, thereby causing the occurrence of the black spots often and deterioration in the dot reproducibility and definition of color images. In case of the combinations Nos. 16, 17 and 18, wherein the developer group with which the turbidity of the black toner becomes 31.5 is used, the dot reproducibility of monochromic and color images was diminished and the image definition became inferior. Further, in case of the combinations Nos. 22 and 23, wherein the photosensitive member group out of this invention is used although the developer group according to this invention is used on the other hand, the dot reproducibility of monochromic and color images was diminished and the image definition similarly became inferior. Among the combinations complying with the requirements of this invention, it is noted that the combinations Nos. 4, 6, 10 and 20, those which are combinations of the photosensitive member group 2 (combinations of the a-Si photosensitive member and the organic photosensitive member containing fluorine-containing resin particles) and the developer groups with which the turbidities of the respective color toners becomes less than 50 and the difference in the turbidities between the respective color toners falls within a range of 10 to 35 at the maximum, and the turbidity of black toner becomes less than 20 show to have the most remarkable improving effects.

Example 2

Example of Modification of Toner Particle Size (Preparation of Toners 7Bk, 7Y, 7M and 7C)

The toners 7Bk, 7Y, 7M and 7C were prepared according to the above-described process for preparing the toners 2Bk, 2Yb, 2M and 2C, except changing the level of classification in the solution by means of a centrifuge to thereby change the value of $M(m_1+m_2)$ and so on. The number-average particle sizes, the values of $M(m_1+m_2)$ and the toner turbidities of the toners 7Bk, 7Y, 7M and 7C are shown in Table 6.

The developers 7Bk, 7Y, 7M and 7C for the evaluation use composing the developer group No. 22 were prepared by mixing 10 parts by mass of each of these toners and 100 parts by mass of ferrite carrier coated with styrene-metacrylate copolymer of which particle size is 45 μm.

(Preparation of Toners 8Bk, 8Y, 8M and 8C)

The toners 8Bk, 8Y, 8M and 8C were prepared according to the above-described process for preparing the toners 2Bk, 2Yb, 2M and 2C, except changing the level of classification in the solution by means of a centrifuge to thereby change the value of $M(m_1+m_2)$ and so on. The number-average particle sizes, the values of $M(m_1+m_2)$ and the toner turbidities of the toners 8Bk, 8Y, 8M and 8C are shown in Table 6.

The developers 8Bk, 8Y, 8M and 8C for the evaluation use composing the developer group No. 23 were prepared by mixing 10 parts by mass of each of these toners and 100 parts by mass of ferrite carrier coated with styrene-metacrylate copolymer of which particle size is 45 μm.

TABLE 6

| Toner No. | Number-average particle size of Toner (μm) | $M(m_1 + m_2)$ (%) | Turbidity | Difference in Turbidity (Max. − Min.) |
|---|---|---|---|---|
| 7Bk | 5.4 | 71.5 | 14.6 | 11.2 |
| 7Y | 5.5 | 72.3 | 25.6 | |

TABLE 6-continued

| Toner No. | Number-average particle size of Toner (μm) | M ($m_1 + m_2$) (%) | Turbidity | Difference in Turbidity (Max. − Min.) |
|---|---|---|---|---|
| 7M | 5.4 | 71.1 | 14.4 | |
| 7C | 5.4 | 72.1 | 15.7 | |
| 8Bk | 5.7 | 68.3 | 21.5 | 15.7 |
| 8Y | 5.8 | 68.5 | 37.2 | |
| 8M | 5.7 | 67.8 | 23.3 | |
| 8C | 5.7 | 68.8 | 23.6 | |

The evaluations were also conducted in accordance with the evaluation process employed in the Example 1, except that the developer group No.4 in the combination No.4 used in the Example 1 was replaced by the developer groups Nos. 22 and 23, respectively.

ABLE 7

| Developer Group (Toner Group) No. | Dot Reproducibility of Monochromic Image | Dot Reproducibility of Color Image | Transfer Error | Black Spot | Image Density | Definition |
|---|---|---|---|---|---|---|
| 22 | ◎ | ◎ | ◎ | ◎ | ◎ | ◎ |
| 23 | ○ | ○ | ○ | ○ | ◎ | ○ |

It may be understood from Table 6 that the developer group No. 22 with which the sum (M) of the relative frequency of the toner particles is 70% or more shows to have more excellent improving effect in the objective items for the evaluation comparing to the developer group No. 23 with which the sum (M) is less than 70%.

Example 3

Example of Using the Image Forming Apparatus of Second Embodiment)

In the following evaluations and comparisons, monochromic images containing both characters with the pixel ratio of 8% and half tone and color images were continuously printed on 50,000 sheets of A4 size with the use of the photosensitive groups and the developer groups (toner groups) composed as shown in Table 8 by means of a digital copying machine mounted with the image forming apparatus of the second embodiment including the respective image forming units of Y (yellow), M (magenta), C (cyan) and Bk (black) at a normal temperatures and humidity (20° C., 50% RH). The ratio of the monochromic images to the color images to print was fixed to a ratio of 9:1, that is, 9 sheets of monochromic images relative to one sheet of color images. However, the printing was temporarily discontinued upon requirements for the following evaluations. The objective items, methods and criteria for the evaluations are as described for the Example 1. The details of the combinations of the photosensitive members and the toners are shown in Table 8, and the results are shown in Table 9.

TABLE 8

| Combination No. | Photosensitive Member No. | Developer Toner No. | Developer Turbidity | Developer Toner No. | Developer Turbidity | Developer Toner No. | Developer Turbidity | Developer Toner No. | Developer Terbidity | Difference in Turbidities (Max − Min) | Remarks |
|---|---|---|---|---|---|---|---|---|---|---|---|
| 24 | 3 | 1Bk | 6.2 | 1Ya | 10.3 | 1M | 6.6 | 1C | 6.4 | 4.1 | Out of the Invention |
| 25 | 3 | 1Bk | 6.2 | 1Yb | 11.4 | 1M | 6.6 | 2C | 11.3 | 5.2 | Within the Invention |
| 26 | 3 | 2Bk | 12.5 | 2Yb | 22.1 | 3M | 19.3 | 2C | 11.3 | 10.8 | Within the Invention |
| 27 | 3 | 3Bk | 18.5 | 2Yf | 58.3 | 3M | 19.3 | 2C | 11.3 | 47.0 | Out of the Invention |
| 28 | 3 | 3Bk | 18.5 | 2Ye | 55.1 | 3M | 19.3 | 2C | 11.3 | 43.8 | Within the Invention |
| 29 | 3 | 4Bk | 22.3 | 4Yb | 55.6 | 4M | 29.3 | 3C | 23.8 | 33.3 | Within the Invention |
| 30 | 3 | 4Bk | 22.3 | 4Yc | 62.2 | 4M | 29.3 | 3C | 23.8 | 39.9 | Out of the Invention |
| 31 | 3 | 5Bk | 31.5 | 4Ya | 33.8 | 5Ma | 33.2 | 5C | 44.7 | 13.2 | Out of the Invention |
| 32 | 3 | 5Bk | 31.5 | 4Ya | 33.8 | 5Mc | 63.3 | 4C | 30.5 | 32.8 | Out of the Invention |

TABLE 9

| Combination No. | Dot Reproducibility of Monochromic Image | Dot Reproducibility of Color Image | Transfer Error | Black Spot | Image Density | Definition | Remarks |
|---|---|---|---|---|---|---|---|
| 24 | ○ | ○ | X | ○ | X | X | Out of the Invention |
| 25 | ◎ | ○ | ○ | ○ | ○ | ○ | Within the Invention |
| 26 | ◎ | ◎ | ◎ | ◎ | ◎ | ◎ | Within the Invention |
| 27 | ○ | X | ○ | ○ | ○ | X | Out of the Invention |
| 28 | ◎ | ◎ | ◎ | ◎ | ◎ | ○ | Within the Invention |
| 29 | ◎ | ○ | ◎ | ◎ | ◎ | ○ | Within the Invention |
| 30 | ○ | X | ○ | X | ○ | X | Out of the Invention |
| 31 | X | ○ | ○ | ○ | ○ | X | Out of the Invention |
| 32 | X | X | ○ | X | ○ | X | Out of the Invention |

As shown in Table 9, the combinations of the photosensitive member groups and the developer groups complying with the requirements of the present invention, that is, the combinations Nos. 25, 26, 28 and 29, those which are combinations of the photosensitive member 3 and the developer groups, with each of those which the turbidity of black toner is less than 25 and the difference in the turbidities between the respective color toners is in a range of 5 to 45 at the maximum, have achieved to obtain good evaluation results more than the practical requirements in terms of the dot reproducibility of monochromic and color images, the transfer error, the black spots, the image density and the image definition. On the other hand, in the combinations Nos. 24, 27, 30, 31 and 32, those which use the photosensitive member 3 but use the developer groups out of this invention, the fluidity of the toner is not sufficient in case of the combination No. 24 with the difference in the turbidity between the respective color toners of 4.1, and therefore, the results for the transfer error, the image density and the image definition were inferior. The combination No. 27 with the difference in the turbidity of 47 something showed the inferior dot reproducibility of color images and deterioration in the image definition due to the unstable balance in the quantity of electrification. Also, in case of the combination No. 30, wherein the developer group with which the turbidity of any of the color toners becomes 60 or more is used, the free external additives came to be excessive in their quantities, thereby causing the occurrence of the black spots often and deterioration in the dot reproducibility and definition of color images. In case of the combinations Nos. 31 and 32, wherein the developer with which the turbidity of the black toner becomes 31.5 is used, the dot reproducibility of monochromic and color images was diminished and the image definition became inferior.

The entire disclosure of Japanese Patent Application No. 2003-179460 filed on Jun. 24, 2003 is incorporated herein by reference in its entirety.

What is claimed is:

1. An image forming apparatus comprising:

four image forming units for black, yellow, magenta and cyan respectively, each image forming unit having at least a developing member; and a photosensitive member on which a toner image is formed with either a black toner, a yellow toner, a magenta toner or a cyan toner of each of developing members, and in which the formed toner image is transferred onto a recording material;

wherein turbidity of each of the black toner, the yellow toner, the magenta toner and the cyan toner used in each developing member of the four image forming units is less than 60, maximum difference between the turbidities of the black toner, the yellow toner, the magenta toner and the cyan toner is in a range of 5 to 45, the photosensitive member is an amorphous silicon-based photosensitive member, and the black toner has the turbidity of less than 25.

2. The apparatus of claim 1, further comprising: an intermediate transfer member for transferring each toner image on the recording material after each toner image formed on the respective photosensitive member is transferred to the intermediate transfer member.

3. The apparatus of claim 1, wherein the maximum difference between the turbidities of the black toner, the yellow toner, the magenta toner and the cyan toner is in a range of 10 to 35.

4. The apparatus of claim 1, wherein the turbidity of the black toner is less than 20.

5. An image forming apparatus comprising:

four image forming units for black, yellow, magenta and cyan respectively, each image forming unit having at least a photosensitive member, an exposing member, a developing member and a transferring member;

wherein the four image forming units form each toner image with either a black toner, a yellow toner, a magenta toner or a cyan toner, on the photosensitive member so that each toner image is transferred on a recording material; and turbidity of each of the black toner, the yellow toner, the magenta toner and the cyan toner is less than 60, maximum difference between the turbidities of the black toner, the yellow toner, the magenta toner and the cyan toner is in a range of 5 to 45, the photosensitive member on which the black toner image is formed is an amorphous silicon-based photosensitive member, and the black toner has the turbidity of less than 25.

6. The apparatus of claim 5, wherein each of the image forming units has a charging member and a cleaning member.

7. The apparatus of claim 6, further comprising: an intermediate transfer member for transferring each toner image on the recording material after each toner image formed on the respective photosensitive members is transferred to the intermediate transfer member.

8. The apparatus of claim 6, wherein the maximum difference between the turbidities of the black toner, the yellow toner, the magenta toner and the cyan toner is in a range of 10 to 35.

9. The apparatus of claim 6, wherein the turbidity of the black toner is less than 20.

10. An image forming apparatus comprising:

four image forming units for black, yellow, magenta and cyan respectively, each image forming unit having at least a photosensitive member, an exposing member, a developing member and a transferring member; and an intermediate transfer member for collectively transferring a color toner image on a recording material after the color toner image is transferred to the intermediate transfer member by overlapping each single color toner image in order, which is formed with either a black toner, a yellow toner, a magenta toner or a cyan toner on each photosensitive member;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, the photosensitive member of the image forming unit for black is an amorphous silicon-based photosensitive member, and the black toner has the turbidity of less than 25.

11. The apparatus of claim 10, wherein each of the image forming units has a charging member and a cleaning member.

12. The apparatus of claim 10, wherein each photosensitive member of the image forming units for yellow, magenta and cyan is an organic photosensitive member.

13. The apparatus of claim 10, wherein the each photosensitive member of the image forming units for yellow, magenta and cyan is an organic photosensitive member of which a surface layer contains fluorine-containing resin particles.

14. The apparatus of claim 10, wherein the maximum difference between the turbidities of the black toner, the yellow toner, the magenta toner and the cyan toner is in a range of 10 to 35.

15. The apparatus of claim 10, wherein the turbidity of the black toner is less than 20.

16. An image forming method comprising:

forming an electrostatic latent image on an amorphous silicon-based photosensitive member, and developing the electrostatic latent image with either a black toner, a yellow toner, a magenta toner or a cyan toner to obtain each of toner image;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, and the turbidity of the black toner is less than 25.

17. The method of claim 16, comprising transferring the toner image to an intermediate transfer member.

18. The method of claim 17, wherein toner images formed with a plurality of color toners are transferred to the intermediate transfer member.

19. The method of claim 16, wherein the difference between the turbidities of the black toner, the yellow toner, the magenta toner and the cyan toner is in a range of 10 to 35.

20. The method of claim 16, wherein the turbidity of the black toner is less than 20.

21. An image forming apparatus for:

developing an electrostatic latent image formed on an amorphous silicon-based photosensitive member with either a black toner, a yellow toner, a magenta toner or a cyan toner to obtain each of toner image; and transferring the toner image to an intermediate transfer member;

wherein turbidity of each of the black toner, the yellow toner, the magenta toner and the cyan toner is less than 60, maximum difference between the turbidities of the black toner, the yellow toner, the magenta toner and the cyan toner is in a range of 5 to 45, and the turbidity of the black toner is less than 25.

* * * * *